US012163299B2

(12) United States Patent
Seegert

(10) Patent No.: US 12,163,299 B2
(45) Date of Patent: Dec. 10, 2024

(54) ADJUSTABLE HAND SHOVEL GUIDE

(71) Applicant: BDS Consulting, LLC, Hartford, WI (US)

(72) Inventor: Brian David Seegert, Hartford, WI (US)

(73) Assignee: BDS Consulting, LLC, Hartford, WI (US)

( * ) Notice: Subject to any disclaimer, the term of this patent is extended or adjusted under 35 U.S.C. 154(b) by 0 days.

(21) Appl. No.: 18/421,367

(22) Filed: Jan. 24, 2024

(65) Prior Publication Data

US 2024/0254707 A1 Aug. 1, 2024

Related U.S. Application Data

(60) Provisional application No. 63/441,227, filed on Jan. 26, 2023.

(51) Int. Cl.
*E01H 5/06* (2006.01)
*E01H 5/02* (2006.01)

(52) U.S. Cl.
CPC ..... *E01H 5/066* (2013.01); *E01H 5/02* (2013.01); *E01H 5/061* (2013.01)

(58) Field of Classification Search
CPC ..... E01H 5/02; E01H 5/066; E01H 5/061; E01H 5/06; E04D 13/106; E02F 3/8152; E02F 9/28
USPC ..... 37/271, 270, 448; 404/97, 119, 37, 39; 172/684.5
See application file for complete search history.

(56) References Cited

U.S. PATENT DOCUMENTS 474,758 A * 5/1892 Osten ..... A01C 7/04 111/71
543,910 A 8/1895 Torr
1,089,427 A * 3/1914 Moody ..... E01H 4/02 37/219
1,887,451 A * 11/1932 Dombrowski ..... E01H 5/066 37/270
2,337,434 A * 12/1943 Washbond ..... E01H 5/062 37/270
2,593,025 A * 4/1952 Hanson ..... E01H 5/066 280/28
2,722,064 A * 11/1955 Jaffe ..... E01H 5/06 37/231

(Continued)

FOREIGN PATENT DOCUMENTS

DE 2361435 A1 6/1975
DE 20303416 U1 10/2003

(Continued)

*Primary Examiner* — Jamie L McGowan
(74) *Attorney, Agent, or Firm* — Boardman & Clark LLP

(57) ABSTRACT

An adjustable shovel guide for a hand shovel includes an apparatus along a side edge of the hand shovel, with the apparatus includes a plate mount removably attached to a blade of the hand shovel along a blade front face and a blade back face between a blade lower surface and a blade upper surface for a first adjustment, a guide plate is removably attached to each of the plate mount, the guide plate has at least one through passage for a second adjustment, an adjustable wear guide slidably is attached to the guide plate for a third adjustment, and the adjustable shovel guide includes-guide wheel attachment, further a method of adjustment is provided.

18 Claims, 16 Drawing Sheets

(56) References Cited

U.S. PATENT DOCUMENTS 2,983,058 A * 5/1961 Hertz ..... E01H 5/066 172/14
3,218,738 A * 11/1965 Bowerman ..... E04D 13/106 294/54.5
D242,761 S 12/1976 DiCarlo
4,073,076 A * 2/1978 Fortune ..... E01H 5/066 293/49
4,290,214 A * 9/1981 Stepe ..... E02F 9/2808 37/444
4,386,474 A * 6/1983 Mechavich ..... E04D 13/106 37/285
4,441,266 A * 4/1984 Westimayer ..... E01H 5/098 172/744
4,570,366 A * 2/1986 Yost ..... E01H 5/061 37/270
4,607,781 A * 8/1986 Shwayder ..... B23K 31/02 228/175
4,804,219 A 2/1989 Berg
4,833,801 A * 5/1989 Winter ..... E01H 5/066 172/701.2
4,865,373 A * 9/1989 Hudson ..... E01H 5/02 37/270
4,899,472 A * 2/1990 Winter ..... E01H 5/066 37/270
D307,378 S 4/1990 D'Alessandro
4,944,104 A * 7/1990 Kowalczyk ..... E01H 5/06 37/231
5,271,169 A 12/1993 Konsztowicz
5,273,375 A * 12/1993 Plourde ..... E02F 3/962 37/444
5,297,351 A * 3/1994 Cote ..... E01H 5/045 37/409
5,408,765 A * 4/1995 Lozensky ..... E01H 5/066 37/231
5,636,458 A * 6/1997 Drake ..... E01H 5/066 37/270
5,794,714 A * 8/1998 Brown ..... A01B 31/00 172/197
5,906,060 A 5/1999 Tonry
6,158,791 A * 12/2000 Drew ..... E04D 15/006 37/285
6,209,235 B1 * 4/2001 Schiltz ..... E02F 3/962 37/285
6,240,660 B1 * 6/2001 Dugas ..... E01H 5/066 37/280
D459,641 S 7/2002 Guneysu
6,799,388 B2 * 10/2004 Weaver ..... E02F 3/8157 37/448
7,100,314 B1 * 9/2006 Jensen ..... E01H 5/066 37/231
7,275,338 B2 * 10/2007 LaHood ..... E02F 9/28 37/449
7,347,014 B1 * 3/2008 Fiandach ..... E02F 3/8157 37/270
8,776,405 B2 * 7/2014 Paonessa ..... E01H 5/062 37/232
8,782,930 B2 * 7/2014 Thomas ..... E01H 5/066 37/270
D741,918 S * 10/2015 Hooijmans ..... D15/28
D758,459 S * 6/2016 Hooijmans ..... D15/28
9,683,341 B2 * 6/2017 Herbon ..... A01B 1/02
9,732,527 B2 * 8/2017 Cohen ..... A01D 7/10
D841,413 S 2/2019 French
D841,414 S 2/2019 French
D841,415 S 2/2019 French
10,557,237 B2 * 2/2020 Kueper ..... E01H 5/066
10,920,425 B2 * 2/2021 Mercier ..... E04D 13/106
10,941,533 B2 3/2021 French
11,261,579 B1 * 3/2022 Willis ..... E02F 5/025
11,946,220 B2 * 4/2024 Vigneault ..... E02F 3/7631
2004/0222652 A1 11/2004 Colville
2005/0184542 A1 8/2005 Moreschini et al.
2005/0246926 A1 * 11/2005 Verseef ..... E01H 5/066 37/281
2005/0265786 A1 * 12/2005 Gresser ..... E01C 19/187 404/118
2006/0042130 A1 * 3/2006 LaHood ..... E02F 9/28 37/449
2007/0145756 A1 6/2007 DeWinter
2007/0177269 A1 * 8/2007 DePaoli ..... E01H 5/066 359/533
2008/0263907 A1 * 10/2008 Winter ..... E01H 5/066 37/270
2009/0293320 A1 * 12/2009 Cummings ..... E01H 5/04 37/270
2011/0198875 A1 8/2011 Smith
2012/0074662 A1 * 3/2012 Sayre ..... E01H 5/066 280/28.17
2014/0366406 A1 * 12/2014 Guggino ..... E01H 5/066 37/270
2016/0069032 A1 * 3/2016 Winter ..... E01H 5/066 37/270
2016/0215465 A1 7/2016 Reid et al.
2016/0230359 A1 8/2016 Derstine
2017/0121921 A1 * 5/2017 Herbon ..... E01H 5/02
2019/0177937 A1 * 6/2019 Guggino ..... E01H 5/066
2019/0177939 A1 * 6/2019 Guggino ..... E01H 5/06
2019/0390423 A1 * 12/2019 Hoffmann ..... E01H 5/066

FOREIGN PATENT DOCUMENTS

DE 102009058776 A1 6/2011
DE 202013011067 U1 2/2014
DE 102014004085 A1 9/2015
DE 202017003544 U1 3/2018
DE 202019000803 U1 5/2019

* cited by examiner

ADJUSTABLE HAND SHOVEL GUIDE

BACKGROUND

Hand shovels provide the ability to remove material from a surface at a larger rate and with greater ease than using other means. Specifically, a hand snow shovel of the prior art will allow a user to remove greater amounts of snow, ice, and other materials than the user seeking other methods. In doing so, the shovel blade, and specifically the front of the shovel blade, is pushed along the surface by the operator. Surfaces can range from concrete, to asphalt, to rock, to sand, to polymer or glass material, and to natural unadulterated surfaces. With that, any one of these surfaces may be uneven, separated by at least one break line where surface sections or planes of the surface are at differing heights. Where the hand shovel of the prior art is pushed along a surface and the surface is uneven, the shovel blade will contact a break line within the surface at the location of planes of differing heights. Specifically, the leading edge, or lower surface, of the shovel blade will first contact the break line. Where the operator is pushing the shovel blade along the surface plane of a lower height than the corresponding surface plane separated by the break line, the lower surface of the shovel blade will contact the vertical, or substantially vertical, surface of the break line. With that, the forward motion of the lower surface of the shovel blade and the shovel as a whole stops. The operator needs to then lift the shovel onto the second, and higher, plane section in order to continue advancement of the prior art shovel. This contact between the lower surface of the shovel and the break line results on wear to the lower surface of the shovel. Further, the operator is required to lift the prior art shovel, both decreasing efficiency of use of the prior art shovel and exposing the operator to potential injury, for example from impacts with break lines in the surface or lifting of the shovel to a surface of a different height.

The prior art is replete with potential solutions to the issue of machinery contacting break lines. However, a majority of these references focus upon non-manual applications. Further, a majority of manual applications focus on attachments to or extensions from the lower surface of the prior art shovel blade. These attachments or extensions limit the ability of the shovel to adjust to varying break line heights which may vary through a single break line or between multiple break lines. A minority of prior art solutions focus upon attachments which attach to the side edges of the prior art shovel blade. However, these solutions are mounted using through holes through the body of the shovel blade. Thus, these prior art solutions are mounted through the prior art shovel blade and substantially permanently affixed to the shovel blade. These prior art solutions do not allow for adjustment of the prior art guide along the prior art shovel blade between the lower surface and an opposite upper surface of the shovel blade without permanently inhibiting the function of the shovel blade itself due to creation of through holes within the shovel. Further such prior art solutions require drilling the stated holes into the blade which takes time reducing the efficiency in operating the shovel. Where the operator seeks to not impair the function of the shovel, the guides are unable to be adjusted to accommodate varying break line heights and wear of the lower surface of the prior art shovel blade. Thus, application of prior art solutions to break lines while shoveling inhibit the ability of the prior art shovel to maneuver varying break line heights, impair the functional application of the prior art shovel itself through the drilling of holes in the blade, result in a process which takes increased time in order to drill such holes through the blade, and may injure or cause accelerated fatigue to the operator due to impacts with break lines in the surface or lifting of the shovel to a surface of a different height or eventual lifting of the shovel carrying material, for example in and over gravel and debris, during operation of the shovel.

Thus, an apparatus is required for addressing break lines while hand shoveling which does not permanently impair the function of the shovel upon an adjustment of the solution on the shovel or removal of the solution from the shovel. Further, an apparatus is required which lifts the shovel over a break line and which allows for continued forward motion of the shovel while proceeding over the break line. The apparatus may additionally prevent injury to and reduce accelerated fatigue to the operator while operating the hand shovel. Further, an apparatus is required for allowing ease of traverse over gaps in the surface which cause shovels of the prior art to stop motion. Additionally, an apparatus is required which compensates for the variations in a shovel angle for example between a shovel blade front face and the surface on which the shovel operates, which may occur due to wear on the shovel and raising or lowering of the shovel handle due to variations in user heights.

SUMMARY

An apparatus for adjustment of a shovel blade for a hand shovel is disclosed herein. The first aspect of the apparatus for an adjustment of a shovel blade for a hand shovel with respect to a surface may comprise: a guide plate removably attached to a shovel blade edge, with the shovel blade having a leading edge substantially orthogonal to the shovel blade edge; the guide plate has a first adjustment, the first adjustment having a position of the guide plate along a length of the shovel blade edge; the guide plate has a second adjustment, the second adjustment having an angle of the guide plate with respect to the shovel blade; and one or more of the first adjustment and the second adjustment has a change of a position of the guide plate with respect to the shovel blade.

The aspect of the apparatus may further comprise at least one plate mount removably attached to the shovel blade edge, the guide plate may be attached to the at least one plate mount. A relocation of the at least one plate mount along the shovel blade edge may provide for the first adjustment allowing for a repositioning of the guide plate along the length of the shovel blade edge.

The aspect of the apparatus may further comprise the guide plate has one or more through passages, with the one or more through passages being elongated, where the second adjustment may be a movement of the guide plate along the one or more through passages. The one or more through passages may be extending substantially orthogonal or acute to the shovel blade edge.

The aspect of the apparatus wherein the guide plate may comprise a base edge. The apparatus may further comprise an adjustable wear guide adjustably attached to the guide plate, proximate to the leading edge, and having a third adjustment. The third adjustment may provide for a change of a position of the adjustable wear guide with respect to the guide plate.

The aspect of the apparatus may further comprise a guide wheel is attached to the guide plate. The guide plate, the guide wheel, and the shovel blade edge may be are in a laminar relationship. The guide wheel may provide for an increased movement of the shovel blade.

A second aspect of the apparatus may comprise a hand shovel having a shovel blade and an adjustable wear guide. The adjustable wear guide may comprise: at least one plate mount removably attached to an edge of the shovel blade, with the shovel blade having a leading edge substantially orthogonal to the edge; a guide plate removably attached to the at least one plate mount; the at least one plate mount having a first adjustment, the first adjustment having a position of the guide plate along a length of the edge; and the guide plate having a second adjustment, the second adjustment having an angle of the guide plate with respect to the shovel blade. The one or more of the first adjustment and the second adjustment may have a change of position of the guide plate with respect to the shovel blade.

The aspect of the apparatus may further comprise the guide plate may have one or more through passages, with the one or more through passages being elongated, where the second adjustment may be a movement of the guide plate along the one or more through passages. The one or more through passages may be extending substantially orthogonal or acute to the edge.

The aspect of the apparatus may further comprise the guide plate has a base edge.

The aspect of the apparatus may further comprise an adjustable wear guide attached to the guide plate, proximate to the leading edge, and having a third adjustment. The third adjustment may provide for a change of a position of the adjustable wear guide with respect to the guide plate.

The aspect of the apparatus may further comprise a guide wheel attached to the guide plate. The guide plate, the guide wheel, and the edge are in a laminar relationship.

A method for adjusting a position of a shovel blade for a hand shovel with respect to a surface may comprise: removably attaching a guide plate to an edge of the shovel. The guide plate may comprise: at least one plate mount removably attached to an edge of the shovel blade; a guide plate removably attached to the at least one plate mount. The method may further comprise making a first adjustment of the at least one plate mount, allowing for a repositioning of the guide plate along a length of the edge; causing a second adjustment allowing for a manipulation of the position of the guide plate with respect to the length; and one or more of the first adjustment and the second adjustment having a change of a position of the guide plate with respect to the shovel blade.

These and other features and advantages of devices, systems, and methods according to this invention are described in, or are apparent from, the following detailed descriptions of various examples of embodiments.

Figure 1:
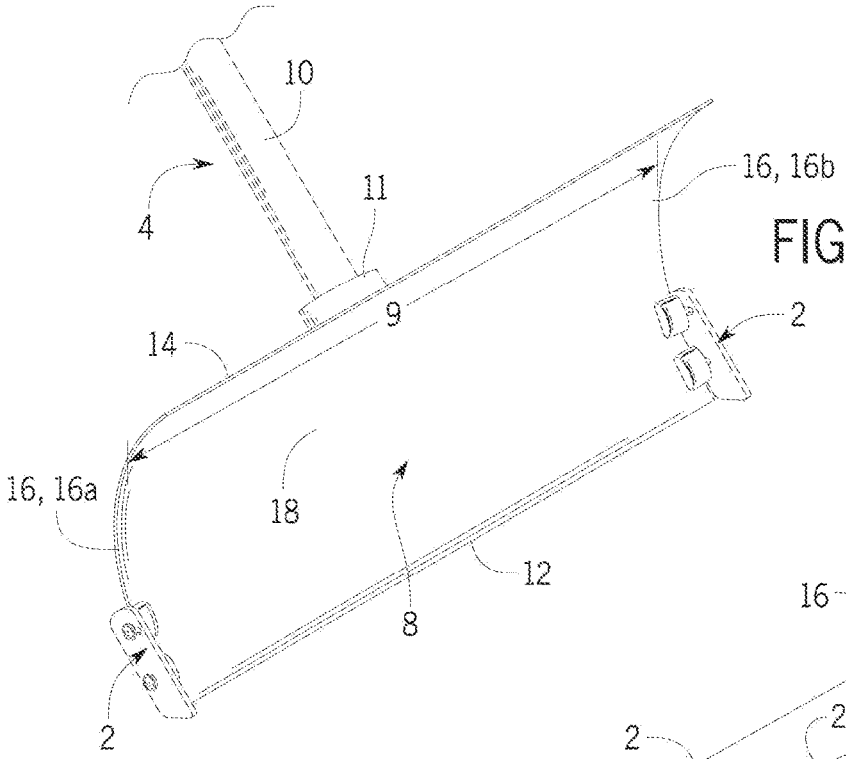
FIG. 1 is an isometric view of the invention for an adjustable hand shovel guide attached to a hand shovel.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiment illustrated herein.

Within the scope of this application, it is expressly intended that the various aspects, embodiments, examples, and alternatives set out in the preceding paragraphs, and the claims and/or the following description and drawings, and in particular the individual features thereof, may be taken independently or in any combination. That is, all embodiments and all features of any embodiment can be combined in any way and/or combination, unless such features are incompatible. The applicant reserves the right to change any originally filed claim or file any new claim, accordingly, including the right to amend any originally filed claim to depend from and/or incorporate any feature of any other claim although not originally claimed in that manner.

DETAILED DESCRIPTION OF THE DRAWINGS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The apparatus depicted provides for an adjustable shovel guide for hand shovels. The adjustable shovel guide attaches to an edge of a shovel blade of the hand shovel. Preferably, the adjustable shovel guide attaches to a side edge of the shovel blade. A first aspect of adjustment of the shovel guide may provide for adjustment of the shovel guide along a length of the side edge of the shovel blade between a lower surface and an upper surface of the shovel blade. A second aspect for adjustment of the shovel guide may provide for an angular adjustment of the position of the shovel guide. Each of the adjustments provides for positioning of the shovel guide with respect to either the shovel or the surface on which a shovel operates. This in turn adjusts the shovel blade lower surface with respect to that surface on which a shovel operates. The adjustments individually and in combination with one another allow a hand shovel upon which the shovel guides are applied to traverse break lines in the surface without a need for additional vertical or lateral movement beyond laterally advancing the shovel blade forward where a lower surface of the shovel blade is generally, but not exclusively, forward with respect to an upper surface of the shovel blade.

With attention to FIG. 1, the invention for an adjustable shovel guide 2 is described. The adjustable shovel guide is preferably mated with a hand shovel 4 in order to assist the hand shovel 4 in advancing along a surface 6, see FIG. 5. The hand shovel 4 comprises a shovel blade 8 connected to a shovel handle 10. The shovel handle having a length with a handle first end 11 connected to the shovel blade 8. The shovel blade 8 extends a blade width 9 at least substantially orthogonal to the handle length. The blade 8 is defined by a lower surface 12 and an opposite upper surface 14. Wherein the lower surface 12 and the upper surface 14 each extend at least substantially the blade width. The hand shovel 4 is designed to preferably advance in the direction of the lower surface 12 with the lower surface 12 leading the remainder of the hand shovel 4 at the leading edge 96, see FIG. 12A. The shovel blade 8 further comprises opposite side edges 16 extending between the lower surface 12 and the upper surface 14 and spaced apart from one another by the blade width 9. Thus, the combination of the lower surface 12, the upper surface 14, and the opposite side edges 16 define the shovel blade 8. With that, the combination of the lower surface, the upper surface, and the opposite side edges further defines a blade front face 18 and the blade back face 19, see FIG. 3, opposite the front face. Operation of the shovel 4 preferably results in material pushed or lifted by the shovel 4 being placed upon or placed in or advanced by the front face 18. Alternatively, at least one of the blade front face 18 and the blade back face 19 is used in moving or transporting material when the hand shovel 4 is in operation. Preferably, the front face 18 is positioned such that the lower surface 12 is the leading edge of the shovel blade 8 in the direction of motion of the hand shovel. The blade 8 may have a concave shape along the blade width with respect to the side edges 16. The blade may be substantially planar from the lower surface to the upper surface. Alternatively, the blade may have a convex shape along the blade width with respect to the side edges 16. With that, the shovel handle 10 attaches to at least one of the blade back face, the upper surface of the blade, at least one of the opposite side edges, and the blade front face. Preferably, the shovel handle attaches to the blade back face.

As stated, the blade comprises the opposite side edges 16, the first side edge 16*a* and the opposite second side edge 16*b*. An adjustable shovel guide 2 is positioned along each of the first side edge 16*a* and the opposite second side edge 16*b*. Further, each guide is positioned respectively on the edges (16*a*, 16*b*) are adjusted in unison in order to traverse the break lines 79, see FIG. 6.

Figure 2:
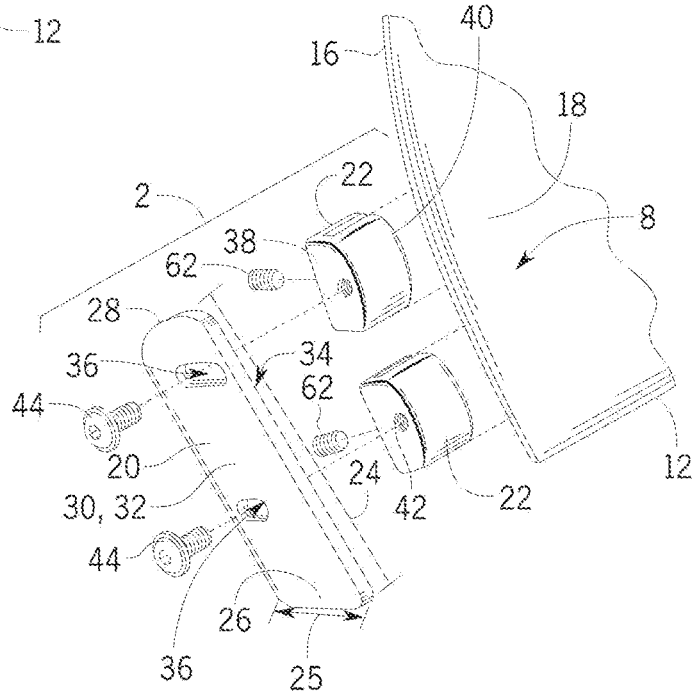
FIG. 2 is a frontal-left perspective exploded view of the adjustable hand shovel guide of FIG. 1.
Figure 3:
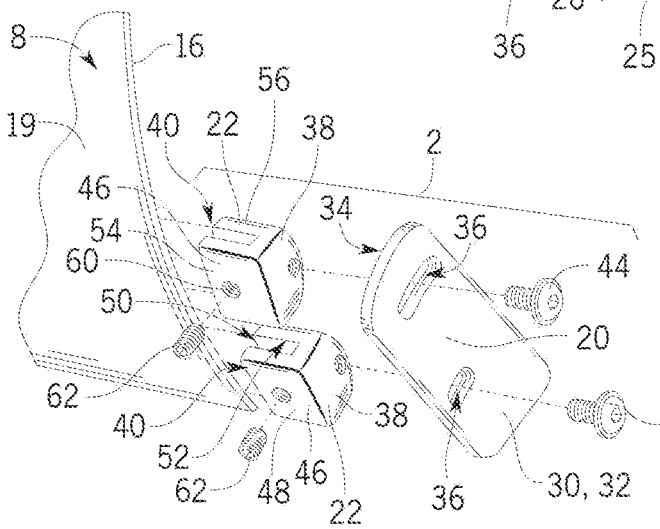
FIG. 3 is a rear-left perspective exploded view of the adjustable hand shovel guide of FIG. 1.

With attention to FIGS. 2 and 3, the adjustable shovel guide is further described. The adjustable shovel guide 2 comprises a guide plate 20 attached to at least one and preferably two guide plate mounts 22. The guide plate 20 is defined by a guide plate length 24 and a guide plate width 25. The guide plate comprises a first end 26 and a second end 28, with the first end 26 and the second end 28 each defined by the guide plate width 25 and separated by the guide plate length 24. The guide plate width 25 and guide plate length define the guide plate body 30. The guide plate body 30 comprises a guide plate first face 32 and a guide plate second face 34 opposite the first face 32. At least one preferably two through passages 36 extend through the first face 32 towards the second face 34. The respective through passages 36 further extend through the second face 34.

The adjustable shovel guide 2 further comprises the at least one and preferable two plate mounts 22. A plate mount 22 comprises a first mount face 38 and an opposite second mount face 40. The first mount face 38 has a bore hole 42.

The bore hole extends towards the second mount face. The bore hole 42 is preferably a threaded bore hole. Alternatively, the bore hole may have a locking mechanism for attachment of the guide plate 20. Alternatively, the bore hole may be at least one of a smooth bore hole or a through hole which receives a locking pin or mechanism for attachment of the guide plate 20. A mounting fastener 44 is placed through each of the guide plate through passages 36. The mounting fastener 44 is preferably a threaded screw. Alternatively, the mounting fastener may be a locking pin or other mechanism known in the art. A receptive mounting fastener firmly and removably attaches the guide plate to the respective plate mount 22. Specifically, the mounting fastener removably attaches the guide plate second face 34 to the first mount face 38. As will be described, the attachment of the guide plate to the plate mount with the mounting fastener allows for the guide plate to be slidably adjustable with respect to the plate mount and the shovel blade. In addition, the attachment allows for the guide plate 20 to be easily replaceable for example in the case of wear and damage to the guide plate 20.

The plate mount 22 comprises a mounting body 46 extending between the first mount face 38 and the second mount face 40. The mounting body 46 has a mounting body first face 48. Preferably, the mounting body first face is substantially orthogonal to at least one of the first mount face and the second mount face. Alternatively, the mounting body first face is not substantially orthogonal to at least one of the first mount face 38 and the second mount face 40.

The second mount face 40 comprises a crevasse opening 50 defining access to a crevasse 52. The crevasse opening 50 extends the entire width of the plate mount 22, thus the crevasse has open sides. The crevasse opening extends into the mounting body 46 towards the first mount face 38 to form the crevasse 52. The crevasse 52 is defined by two sections of the mounting body, the mounting body first arm 54 and the mounting body second arm 56. The mounting body first arm 54 and the mounting body second arm 56 are substantially parallel to one another and extend in a direction opposite the first mount face 38 towards the second mount face 40 and culminate to form the second mount face. The extension of the substantially parallel arms (54, 56) and the orientation of the crevasse opening 50 provide for the crevasse extending the entire width of the plate mount and extending a second direction towards the first mount face 38 as stated. At least one of the opposite side edges 16 of the shovel blade 8 are inserted into the crevasse 52 of the plate mounts for the respective blade guide 2. This occurs whether mounted on the first side edge 16*a* or the second side edge 16*b*, see FIG. 1. With that, the mounting body first arm 54 is in close proximity to and positioned behind the blade back face 19 with respect to the lower surface of the blade. As noted, the blade back face 19 is a surface of the blade 8 opposite the blade front face 18. Further, the mounting body second arm 56 is in contact with the blade front face 18. Thus, the portion of the blade within the crevasse is between the mounting body first arm and the mounting body second arm in a lamented or layered orientation.

A mounting first arm through hole 60 extends from mounting body first face 48 of the mounting body first arm 54 through the mounting body first arm towards the crevasse and opens into the crevasse. The through hole 60 is preferably threaded. A screw 62 is thread ably positioned in the through hole 60. Screw 62 may preferably be a set screw. The screw is adjusted to contact the blade back face 19 and secure the plate mount 22 to the shovel blade 8. The screw does not create or set into a through hole in the blade 8. The screw firmly and removably rests against the blade causing the blade to be sandwiched between the screw and mounting body second arm 56. Alternatively, the screw and the mounting body first arm are substantially planar causing a press fit by both the screw and the mounting body first arm onto the blade 8. Alternatively, the mounting body may be applied to the blade without use of a screw in an over-center, snap-fit or compression fit orientation. Thus, contrary to the prior art the screw does not alter the blade or alter the performance of the blade by the need for or creation of a through hole in the blade 8. Unlike the prior art, the lack of requiring or creating a through hole in the blade allows for the screw to be adjusted, and the plate mount 22 to be repositioned at various locations along the blade from the lower surface 12 of the shovel blade to the upper surface 14 of the shovel blade with minimal delay in the operation of the hand shovel.

Figure 4:
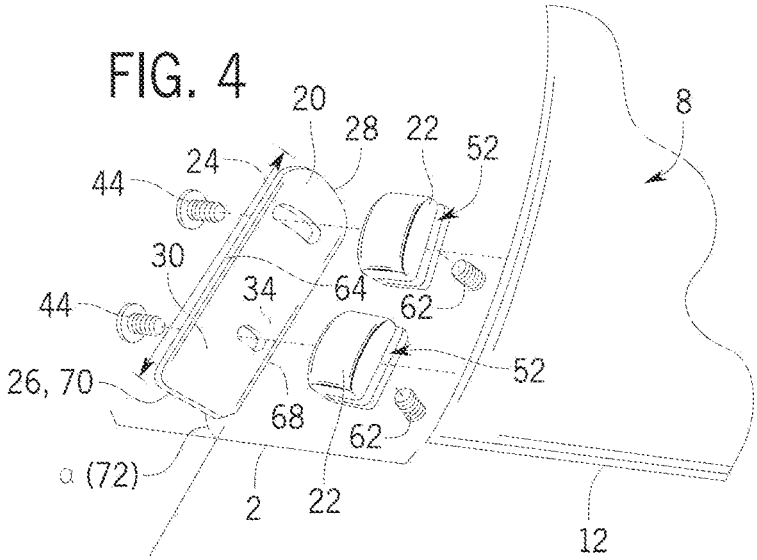
FIG. 4 is a frontal-left perspective exploded view of the adjustable hand shovel guide of FIG. 1.

With attention to FIGS. 2 and 4, the guide plate 20 is further described. Along the guide plate length 24 of the guide plate 20, the guide plate 20 is defined by a front length edge 64 and an opposite back length edge 68. The front length edge 64 and the back length edge 68 are separated by the width 25 along the guide plate length 24. At the guide plate first end 26, the guide plate first end edge 70 defines the guide plate first end. The guide plate first end edge 70 extends generally from the back length edge 68 to the front length edge 64. The first end edge is oriented away from the guide plate second end 28 from the back length edge 68 to front length edge 64 at an angle $\alpha$ (72).

Figure 5:
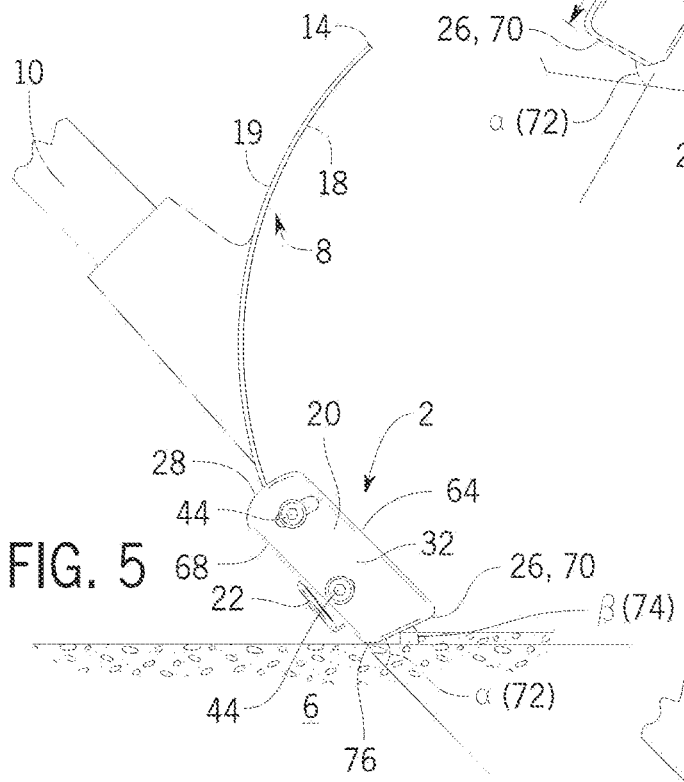
FIG. 5 is a left side view of the adjustable hand shovel guide of FIG. 1.
Figure 6:
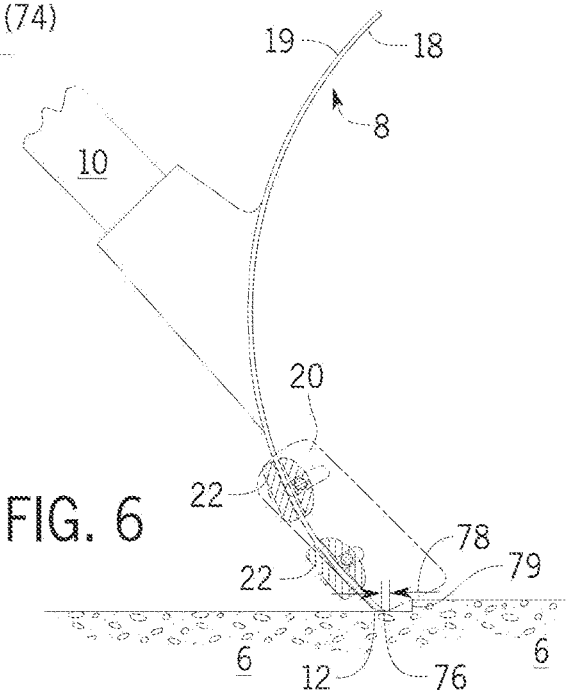
FIG. 6 is a left side view of the adjustable hand shovel guide of FIG. 1, illustrating plate mounts.
Figure 12A:
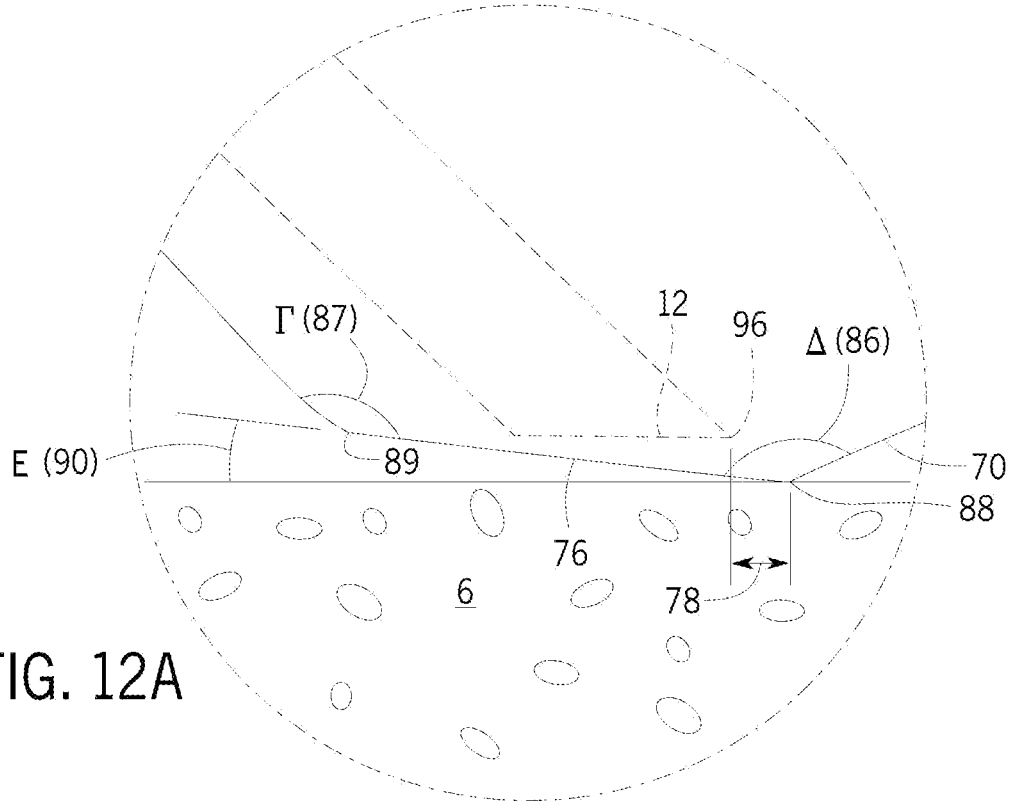
FIG. 12A is a focused view of FIG. 8A.

With attention to FIGS. 5, 6, and 12A, orientation of the adjustable shovel guide 2, with respect to the surface 6 on which the shovel guide 2 is operated, is explained. The adjustable shovel guide 2 is positioned on, removably attached to, the shovel blade 8 such that the guide plate first end 26 and specifically the first edge 70 is positioned in close proximity to, if not in contact with, the surface 6. The angle $\alpha$ (72) provides for the first edge 70 being angled over the surface 6 at an angle $\beta$ (74). Where the angle $\beta$ (74) is defined as the angle between the surface 6, which a base edge 76 is in contact with or in close proximity to, and the first edge 70. The base edge 76 is positioned at the rear corner of the blade between 68 and 70 and connects the first edge 70 with the back length edge 68. Further, the base edge 76 of the guide plate contacts the surface 6. The base edge 76 is the only location of the guide plate 20 which contacts the surface 6 where the surface 6 is planar without a break line. As seen in the figures, the first edge 70 contacts the surface and break line when the guide plate is in close proximity to the break line in order to allow for progressive lateral movement of the shovel blade with respect to the surface without requiring the operator to apply a vertical or substantially vertical movement. The base edge 76 is an angular surface with a substantially flat contour positioned between the first edge 70 and the back length edge 68.

The base edge 76 is positioned such that a leading edge 96 of the lower surface 12 of the blade 8 is positioned a distance 78 behind a base edge first corner 88. Alternatively, the leading edge 96 is positioned planar to the base edge first corner 88, where planar equates to a position normal to the surface 6 when viewed from the side edge 16. The leading edge 96 of the lower surface 12 may also be placed ahead of the base edge first corner 88. Positioning of the base edge 76 such that the leading edge 96 is planar to or behind the base edge first corner 88 provides for the raising of the lower surface 12 in advance of the break line 79. The break line 79 separates planes of the surface 6 with varying heights on either side of the break line 79. Positioning the leading edge 96 ahead of the base edge first corner 88, in the direction of movement where the front face 18 leads the back face 19, provides for aggressive removal of material on the surface 6. Having the ability to position the base edge first corner 88 either before or planar to the leading edge 96 provides for an advantage over the prior art. In the prior art even where a guide may be provided, such an adjustment is not available, resulting in the leading edge of the prior art shovel contacting the surfaces defining break line stopping forward motion of the shovel, for example with large break lines. By contrast, the invention allows for maintaining the forward motion of the shovel, or ease of adjustment to maintain the forward motion, without a significant delay or altering the shovel blade. Additionally, the invention allows the operator to maintain a forward motion without a need for the operator to apply a vertical or substantially vertical movement.

Figure 7:
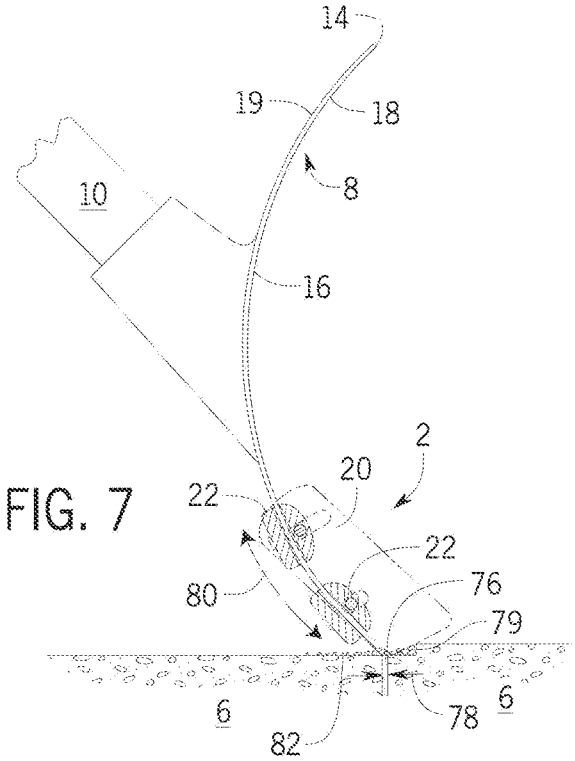
FIG. 7 is a left side view of the adjustable hand shovel guide of FIG. 1, illustrating a first adjustable aspect.

With attention to FIGS. 3 and 7, a left side view of the shovel guide 2 illustrates a first adjustable aspect 80 of the adjustable shovel guide 2. The first adjustable aspect 80 of the guide 2 provides for adjustment of the guide 2 along the edge 16 between the lower surface 12 and the upper surface 14, see FIG. 1. This first adjustable aspect 80 is provided for with the plate mount 22 and the screw 62. The screw 62 of each plate mount 22 of the guide 2 is loosened and each plate mount 22 is adjusted along the edge 16. Once the guide plate 20, and plate mounts 22, are in a desired location the screw 62 for each plate mount 22 is tightened against the blade 8. The guide 2 is then removably fixed against the blade 8, as previously described, without causing or requiring through holes or other feature change to the blade 8. The first adjustable aspect 80 is applied in order to raise the lower surface of the blade above the surface 6. This accommodates for break lines resulting in planes of the surface 6 with height differentials. These height differentials may result in contact of a lower surface in the prior art to contact the break line during operation. Thus, aspect 80 may be applied to raise the blade above the height differential. Further, first adjustable aspect 80 may be applied to accommodate for surfaces comprising loose material 82. In such a scenario, the operator may seek to avoid contacting the loose material on the surface 6 while moving a different material to be removed or transported which is positioned over the loose material 82 for example but not limited to moving snow, ice or a secondary loose material positioned over a surface comprising gravel or loose rocks. Alternatively, aspect 80 can be used to lower the blade 8 to contact the surface 6, when not trying to avoid loose material on the surface.

Figure 8A:
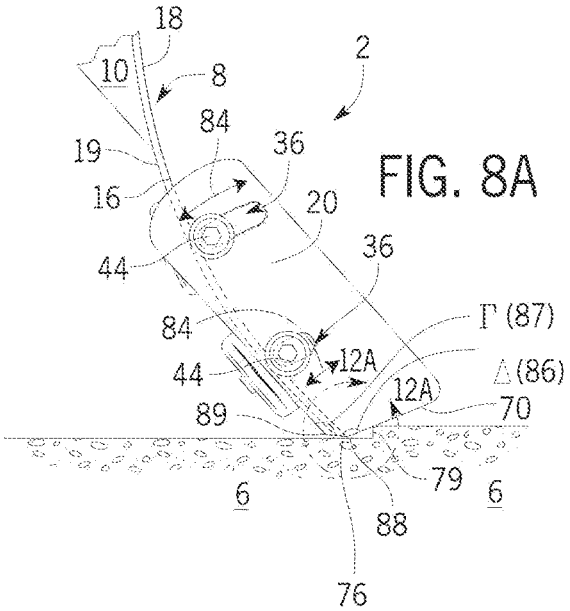
FIG. 8A is a left side view of the adjustable hand shovel guide of FIG. 1, illustrating a second aspect for adjustment of a guide plate into a first position.

With attention to FIGS. 8A to 12B, a second aspect for adjustment 84 of a guide plate 20 is illustrated. As illustrated in FIGS. 5, 8A, and 8B, the base edge is defined by two opposite ends, a base edge first corner 88 and a base edge second corner 89. At a base edge first corner 88, the base edge 76 extends at an obtuse angle Δ (86) from the guide plate first end edge 70 in the direction of the back length edge 68. It is observed the base edge first corner 88 is proximate to the lower surface 12 of the blade 8 where the second corner 89 is distal to the lower surface of the blade with respect to the first corner 88. At a base edge second corner 89, the base edge 76 extends at an obtuse angle Γ (87) from the back length edge 68 towards the guide plate first end edge 70. As illustrated in FIGS. 5, 8A and 8B, the second aspect for adjustment 84 provides for the through passages 36 of the guide plate 20 extending substantially between the front length edge 64 and the back length edge 68. Thus the through passages are linear in dimension between the front length edge and the back length edge. Preferably each of the through passages 36 comprises an arcuate passage, bending in the direction of the guide plate second end 28, between the front length edge 64 and the back length edge 68.

As illustrated in FIGS. 8A and 12A, when each of the mounting fasteners are positioned in a first position of the through passages 36, the base edge first corner 88 comes in close proximity to or contacts the surface 6 creating an angle E(90) between the base edge 76 and the surface 6 in the direction of the base edge second corner 89 which is raised above the surface. Thus, the guide plate is in a guide plate first position. This orientation provides for the guide plate first end edge 70 to be at a first acute angle with respect to the surface 6. The first acute angle provides for break lines where the planes opposite and orthogonal to the break line have a first differential in height.

Figure 8B:
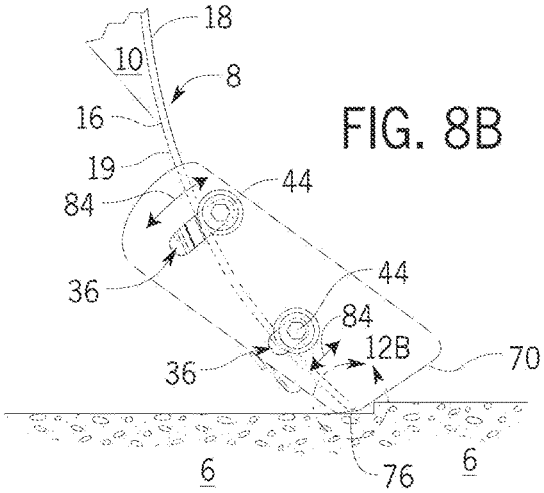
FIG. 8B is a left side view of the adjustable hand shovel guide of FIG. 1, illustrating the second aspect for adjustment of the guide plate into a second position.
Figure 12B:
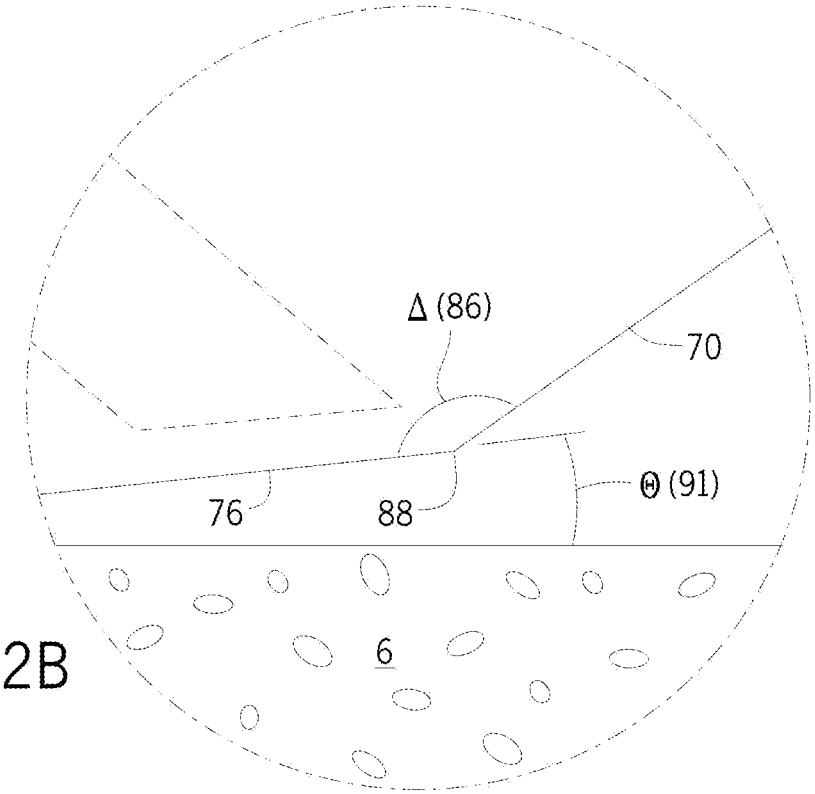
FIG. 12B is a focused view of FIG. 8B.

As illustrated in FIGS. 8B and 12B, when each of the mounting fasteners are positioned in a second position of the through passages 36, the base edge second corner 89, see FIG. 8A, comes in close proximity to or contacts the surface 6 creating an angle Θ (91) between the base edge 76 and the surface 6 in the direction of the guide plate first end edge 70 causing the base edge first corner 88 to be positioned above the surface 6. Thus the guide plate is in a guide plate second position. This orientation provides for the guide plate first end edge 70 to be at a second acute angle with respect to the surface 6. The second acute angle provides for break lines where the planes opposite and orthogonal to the break line have a second differential in height. The first differential height being less than the second differential in height. Thus, movement of the guide plate so that the fastener is located at the second position of the through passages may allow the hand shovel to address break lines having plane differentials which are greater than what is allowed by blade when the mounting fasteners are the first position of the through passages.

Figure 9A:
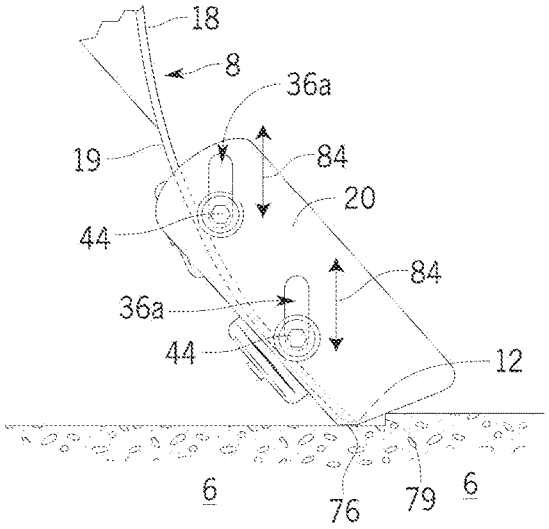
FIG. 9A is a left side view of the adjustable hand shovel guide of FIG. 1, illustrating the second aspect for adjustment of a guide plate into the first position with a second version of guide plate through passages.
Figure 9B:
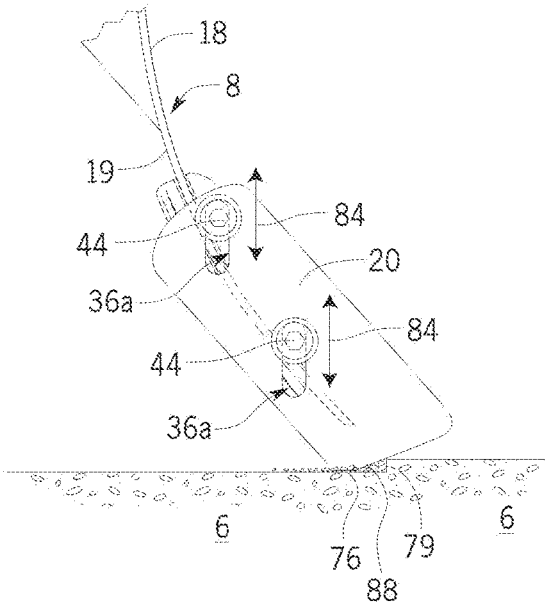
FIG. 9B is a left side view of the adjustable hand shovel guide of FIG. 1, illustrating the second aspect for adjustment of the guide plate into the second position with a second version of guide plate through passages.

As illustrated in FIGS. 9A and 9B, the second aspect for adjustment of the guide plate 20 is further illustrated with a second aspect of through passages 36*a* for the guide plate 20. With such, the through passages 36*a* such that the length of the through passages, which is greater than a width of the through passages, is oriented at least substantially orthogonal to the surface 6 when the guide is mounted to the blade. The base edge 76 is positioned on the surface 6 along the length of the base edge 76. Alternatively, the base edge 76 is positioned substantially close to the surface 6 along the length of the base edge 76. As illustrated in FIG. 9A, when the mounting fasteners are adjusted to the first position in the through passages 36*a*, the lower surface 12 is positioned on or in close proximity to the surface 6. Thus, the guide plate is in the guide plate first position. When the mounting fasteners are adjusted to the second position of the through passages 36*a*, the lower surface 12 is raised above the surface 6 at a height over the surface 6 that is greater than the height of the lower surface 12 when the mounting fasteners are in the first position of the through passages. Thus, the guide plate is in the guide plate second position. Adjusting the guide plate so that the mounting fasteners in the second position of the through passages accommodates for the differential heights of break line as previously discussed in that the second position may allow the shovel to traverse break lines having a greater height than when the guide plate is in the first position of the through passages. Adjusting the guide plate so that the mounting fasteners in the second position of the through passages additionally allows the operator to avoid contacting loose material of the surface as previously discussed.

Figure 10A:
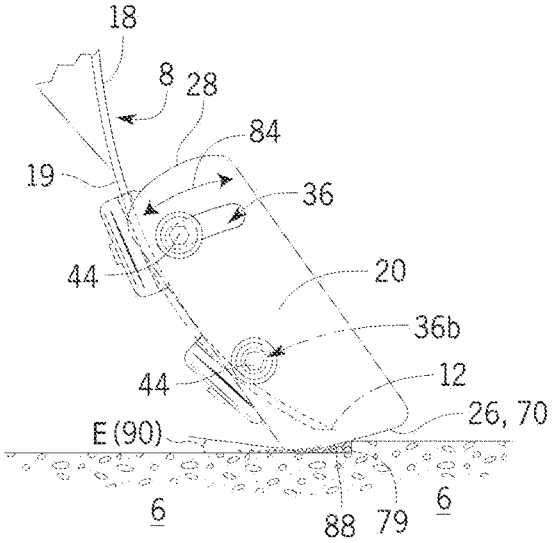
FIG. 10A is a left side view of the adjustable hand shovel guide of FIG. 1, illustrating the second aspect for adjustment of the guide plate into the first position with a third version of guide plate through passages.
Figure 10B:
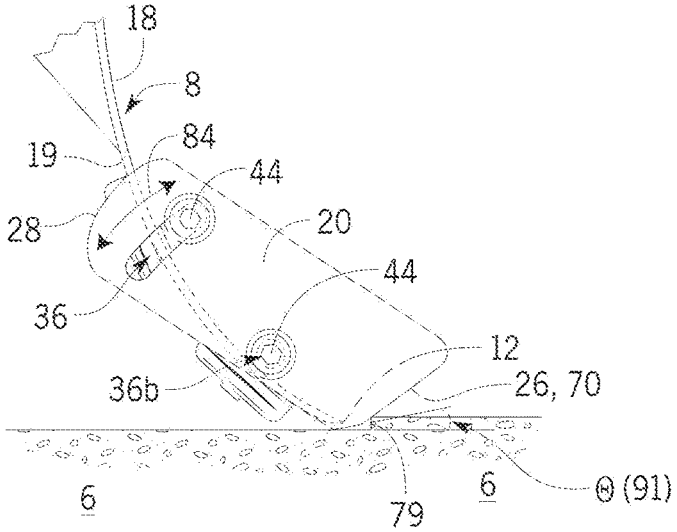
FIG. 10B is a left side view of the adjustable hand shovel guide of FIG. 1, illustrating the second aspect for adjustment of the guide plate into the second position with the third version of guide plate through passages.

With attention to FIGS. 10A and 10B, the second aspect for adjustment of the guide plate 20 is further illustrated with a third aspect of through passages for the guide plate 20. In this orientation, the through passages (36, 36*b*) of the guide plate vary in dimension. A first through passage 36 is proximate to the guide plate second end 28. The second through passage 36*b* is a through hole. Thus, the mounting fastener 44 positioned through the second through passage 36*b* does not linearly adjust, or minimally adjusts linearly, with respect to the through passage 36*b*. As a result linear adjustment of the mounting fastener positioned through the first through passage 36 rotates the plate 20 about the second through passage 36*b*. The result is the positioning and angles equivalent to or at least substantially similar to E (90) and Θ (91) as respectively described in FIGS. 12A, and 12B. Further, as illustrated in FIG. 10A, the lower surface 12, and the leading edge 96 (see FIG. 12A), raises when the mounting fastener in the first through passage 36 is in a first position, and thus the guide plate is in the guide plate first position. This allows for the operator to traverse the shovel blade along the surface 6 without having to raise the shovel blade 8 when a break line is proximate to the lower surface 12. As illustrated in FIG. 10B, having the mounting fastener positioned through the first through passage 36 in the second position, with the guide plate in the second position, allows for a proximate position of the lower surface 12, and the leading edge 96 (see FIG. 12A), to the surface 6 as compared to when the mounting fastener is at the first position of the first through passage 36. Thus, when the mounting fastener is in the second position of the first through passage 36, and thus the guide plate in the guide plate second position, the lower surface is positioned at or near the surface in order to allow increased quantities of material on or close to the surface to enter the blade as compared to when the mounting fastener is in the first position of the first through passage 36.

Figure 11A:
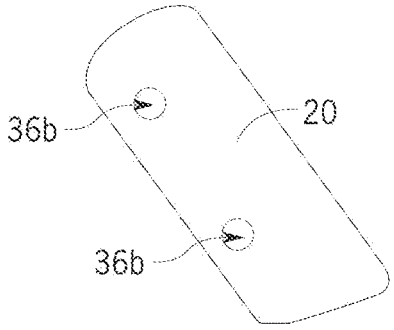
FIG. 11A is a left side view of the guide plate, illustrating a fourth version of guide plate through passages.
Figure 11B:
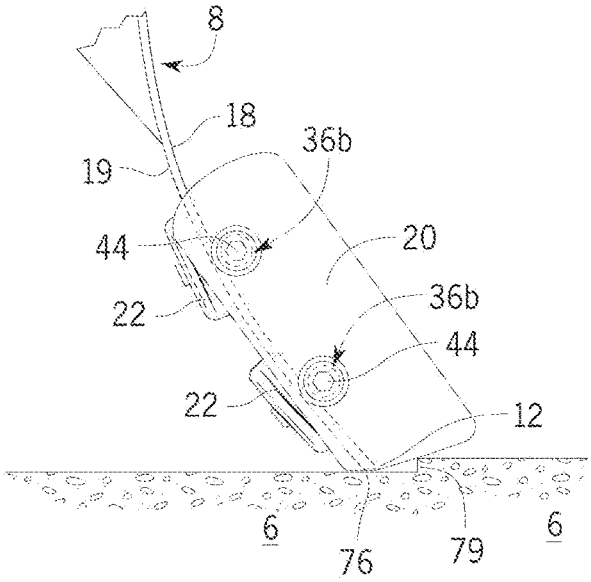
FIG. 11B is a left side view of the adjustable hand shovel guide of FIG. 1, illustrating the second aspect for adjustment of the guide plate with the fourth version of guide plate through passages.

With attention to FIGS. 11A and 11B, the second aspect for adjustment of the guide plate 20 is further illustrated with a fourth aspect of through passages for the guide plate 20. The through holes of the fourth aspect are at least substantially equivalent to the second through passages 36*b*. As a result, when the guide plate is positioned against the plate mounts 22, the guide plate is fixed with respect to the second aspect for adjustment. The position of the guide plate 20 and lower surface 12 when using the fourth aspect of the through passages, which amounts to the two through passages 36*b* as previously described, is dependent upon the position of the through passages 36*b* through the guide plate 20 and the guide plate mount position.

With attention to FIGS. 8A to 11B, the orientations and positioning of the guide plate 20 as described in any of FIGS. 8A to 11B applies to each version of the guide plate through passages as provided in FIGS. 8A to 11B.

Figure 13A:
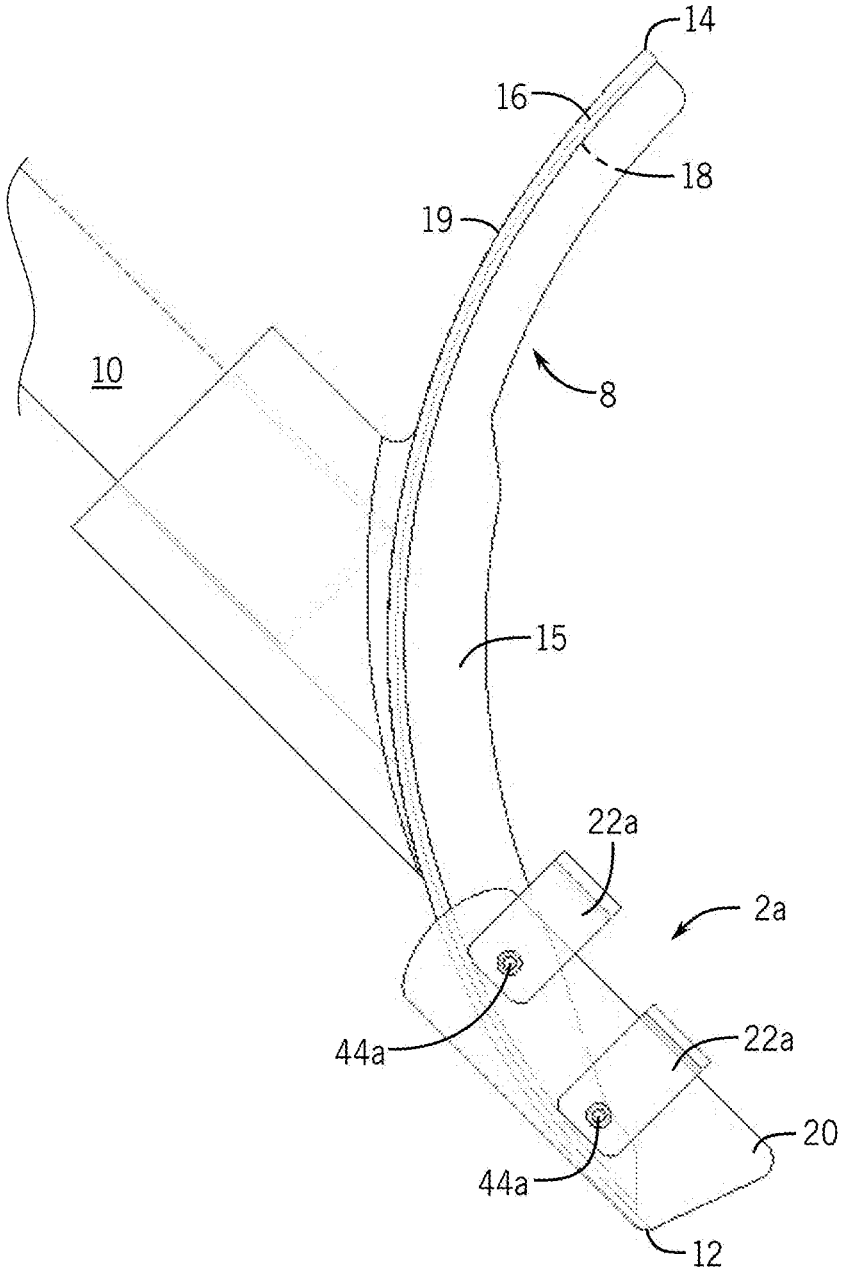
FIG. 13A is a left side view of a second embodiment for the invention for an adjustable hand shovel guide.
Figure 13B:
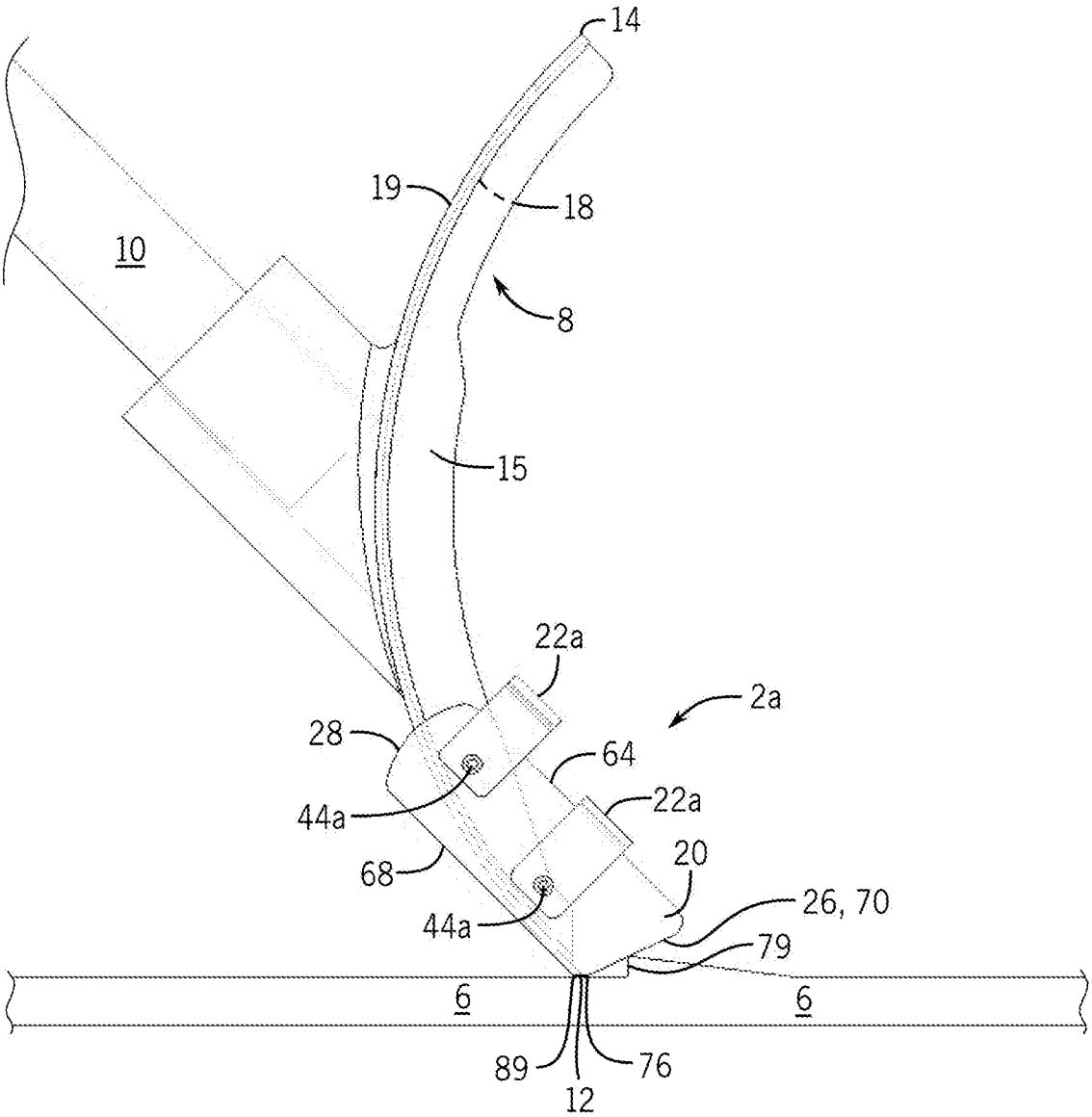
FIG. 13B is a left side view of the adjustable hand shovel guide of FIG. 13A in contact with a surface.
Figure 13C:
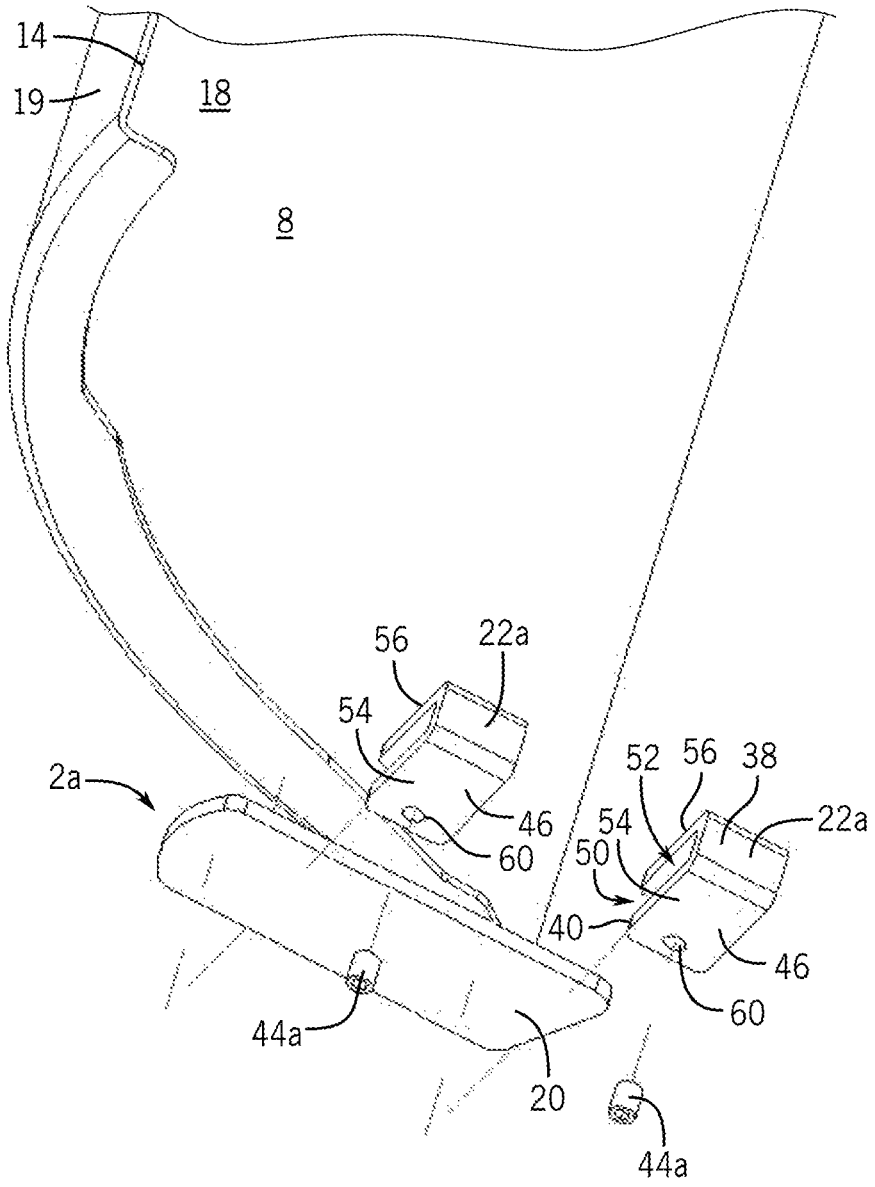
FIG. 13C is an exploded view of the adjustable hand shovel guide of FIG. 13A.

With attention to FIGS. 13A to 13C, a second embodiment of the invention for an adjustable shovel guide 2*a* is provided. At least one element, feature and advantage of the invention for an adjustable shovel guide 2 may be incorporated in the second embodiment of the invention for an adjustable shovel guide 2*a*, and at least one element, feature and advantage of the second embodiment of the invention for an adjustable shovel guide 2*a* may be incorporated in the invention for an adjustable shovel guide 2, see FIG. 2. The adjustable shovel guide 2*a* comprises the guide plate 20, at least one and preferably two second embodiment of the plate mounts 22*a*. At least one element, feature and advantage of the invention for the plate mount 22 may be incorporated in the second embodiment of the plate mount 22*a*, and at least one element, feature and advantage of the plate mount 22*a* may be incorporated in the invention for the plate mount 22. The adjustable shovel guide 2*a* further comprises mounting fasteners 44*a* for adjustable placement of the guide plate 20 as previously described. The plate mount 22*a* is designed to removably affix the guide plate to at least a side transverse edge 15 of the shovel blade 8. The side transverse edge 15 extends from substantially close to the lower surface 12 to substantially close to the upper surface 14 of the shovel blade 8 and is positioned on at least one of the side edges 16 of the shovel blade 8, or in close proximity to the respective side edge 16. Additionally, the transverse edge 15 may be at a different plane with respect to the blade edge 16 which is offset from the blade edge 16. As with the prior embodiment of the invention for an adjustable shovel guide 2, the second embodiment of the adjustable shovel guide 2*a* provides for the plate mounts being slidably adjustable along the side transverse edge 15 so that the guide plate 20, and the invention as a whole, adjusts in at least one of the first and second aspects of adjustment between the lower surface 12 and the upper surface 14.

As further illustrated in FIGS. 13A to 13C, the second embodiment of the adjustable shovel may be oriented in the same manner with respect to the ground as illustrated and previously described for the adjustable shovel guide 2, see also FIGS. 2-11B. As previously illustrated, the plate mount 22*a* comprises many of the properties of the plate mount 22, such first mount face 38, second mount face 40, mounting body 46, crevasse opening 50, crevasse 52, mounting body first arm 54, mounting body second arm 56, and mounting first arm through hole 60. The side transverse edge 15 is positioned into crevasse 52 of the plate mount 22*a* such that the transverse edge 15 is oriented in proximity the first mounting face 38. This is repeated for the number of mounts applied to the respective side of the shovel blade 8. The guide plate 20 is positioned as previously described with respect to the shovel blade 8, and in a manner so that the guide plate 20 is sandwiched or layered between either of the mounting first arm 54 or mounting second arm 56 and the transverse edge 15 of the blade 8. The fit of the guide plate 20 as described may be a compression fit. In addition, a mounting fastener 44*a* is placed within each mounting first arm through hole, as previously described. This fastener 44*a* further provides compression onto the guide plate 20 to maintain the position of the guide plate. It is observed the guide plate does not contain the embodiments of the through holes or through passages (36, 36*a*, 36*b*) as previously described. Alternatively, it is observed the guide plate 20 may contain at least one of the embodiments of the through holes or passages (see FIGS. 8B-9B) as previously described. Where a through hole or passage (see FIGS. 8B-9B) is present, the mounting fastener 44*a* may be in contact with the side transverse edge 15 in order to maintain the position of the guide plate 20. The mounting fastener may be positioned so that the mounting first arm through hole 60 is positioned against an inner side of the transverse edge 15, where the inner side is opposite the guide plate 20.

Figure 14A:
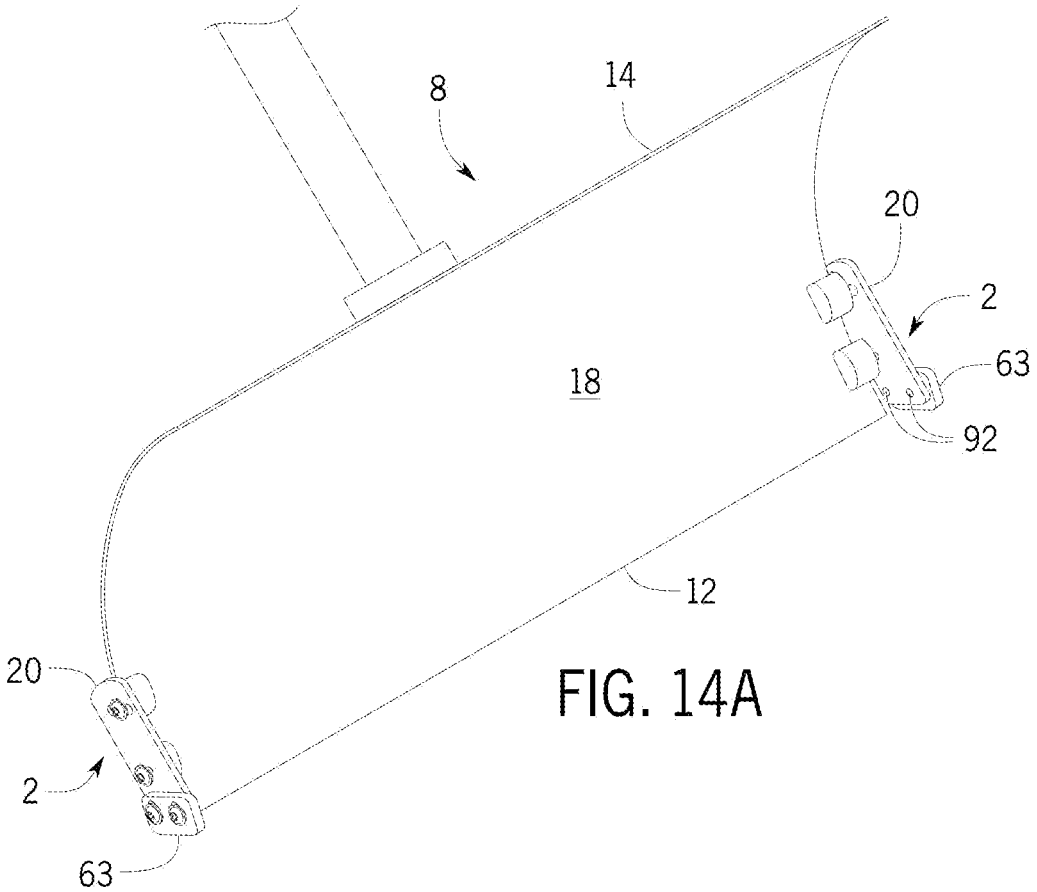
FIG. 14A is an isometric view of the invention for the adjustable hand shovel guide attached to the hand shovel illustrating an adjustable wear guide in connection with the guide plate.
Figure 14B:
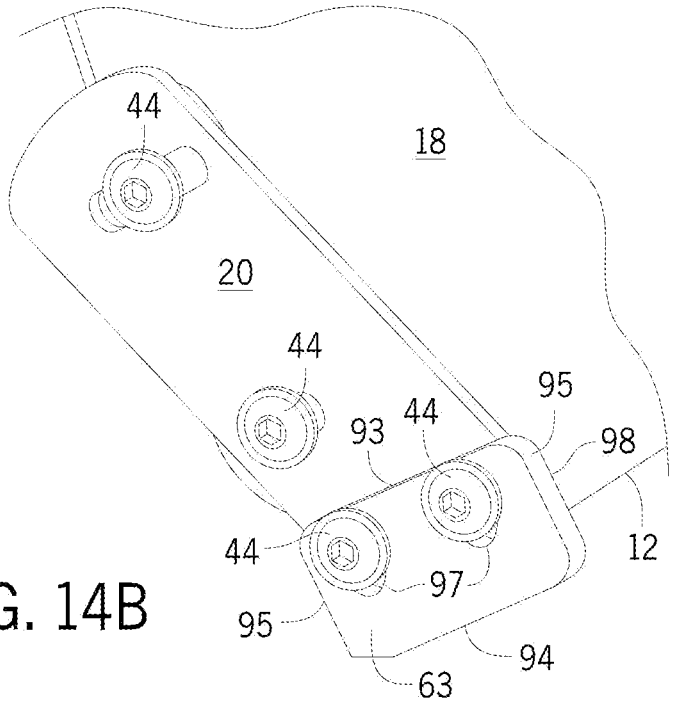
FIG. 14B is a frontal-left perspective view of the invention for the adjustable hand shovel guide of FIG. 14A illustrating the adjustable wear guide in connection with the guide plate.
Figure 14C:
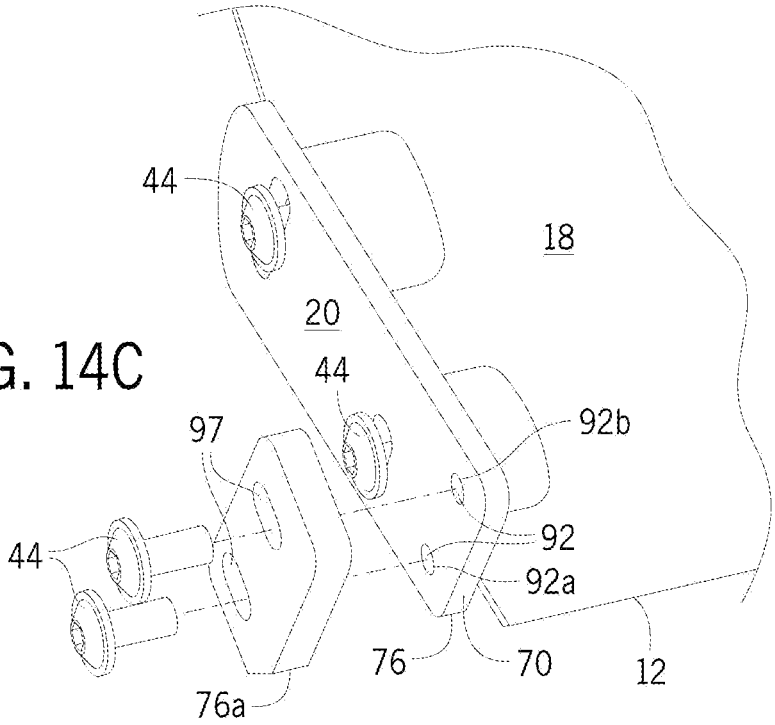
FIG. 14C is a frontal-left perspective exploded view of the invention for the adjustable hand shovel guide of FIG. 14A illustrating an adjustable wear guide in connection with the guide plate.
Figure 14D:
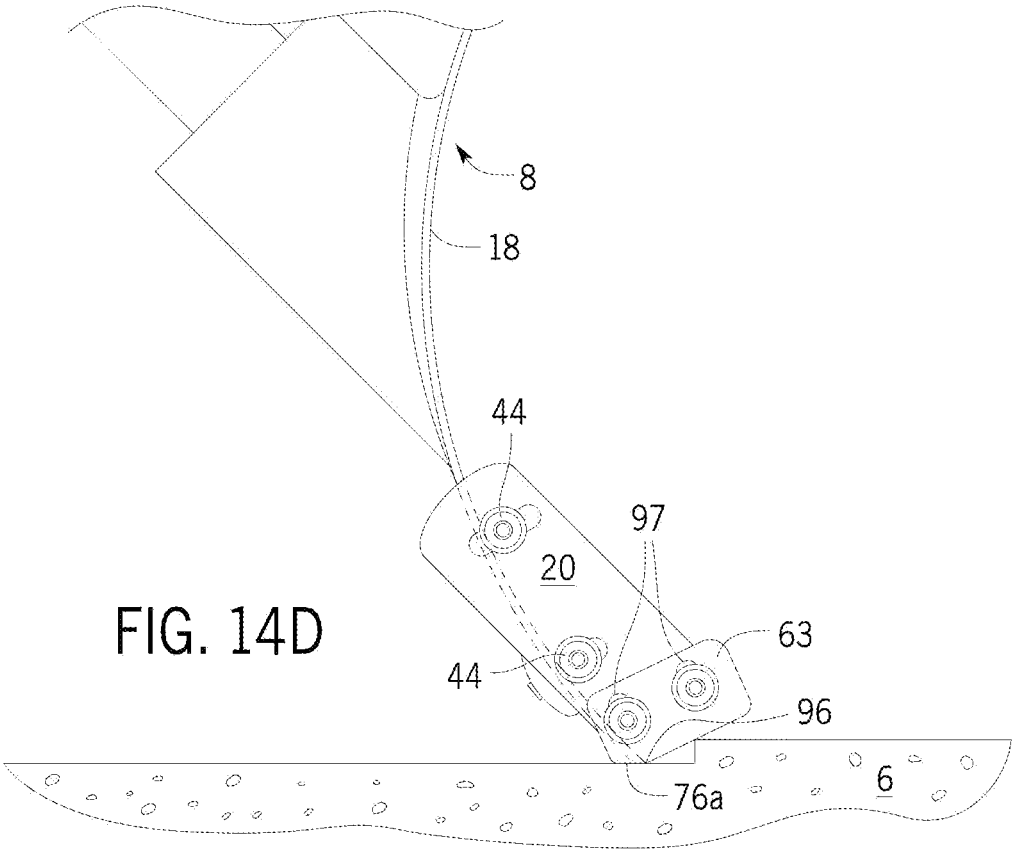
FIG. 14D is a left side view of the invention for the adjustable hand shovel guide of FIG. 14A illustrating a positioning of the adjustable wear guide with respect to the shovel blade.

With attention to FIGS. 14A-14D, the invention for the adjustable hand shovel guide attached to the hand shovel may further comprise an adjustable wear guide 63 in connection with the guide plate 20. As illustrated by FIG. 14C, the guide plate 20 comprises two through holes 92. A first through hole 92*a* is positioned proximate to the base edge 76, and the second through hole 92*b* is positioned distal with respect to the base edge 76 and proximate to the first end edge 70. As illustrated in FIG. 14B, the adjustable wear guide 63 is defined by an adjustable wear guide first edge 93, an adjustable wear guide second edge 94 at least substantially parallel to the first edge 93, and two opposing sides 95 each positioned between the respective parallel edges (93, 94). Two vertical, or substantially vertical, through holes 97 are positioned through a wear guide body of the adjustable wear guide 63, defined by the collaboration of the edges and sides. Preferably, the through holes 97 are elongated through holes. Alternatively, the through holes are circular. The through holes 97 align with the first through hole 92*a* and second through hole 92*b* respectively. A fastener 44 is positioned through each respective through hole 97 of the adjustable wear guide 63 and a fixed into the respective through hole (92*a*, 92*b*) of the guide plate 20. The vertical through holes 97 allow the adjustable wear guide to adjust orthogonally or substantially orthogonal with respect to the surface 6, see FIGS. 14B and 14D. This adjustment provides for a raised orientation of the leading edge 96 with respect to the surface 6. This adjustment in the raised orientation allows for a disconnection between the surface 6 and the leading edge 96, which results in a reduction of a risk of injury to the operator and allows for the operator to more easily move the shovel blade 8 over the surface 6 while cleaning and/or clearing the surface 6. As illustrated in FIG. 14D, the adjustable wear guide 63 comprises an adjustable wear guide base edge 76*a*. When in position against the guide plate 20, the base edge 76*a* is positioned proximate to the base edge 76 of the adjustable wear guide, and the base edge 76*a* is in contact with the surface 6. The base edge is distal with respect to a lead side 98 of the adjustable wear guide. The lead side 98 is positioned in the direction of a forward movement of the shovel blade 8 during operation of the shovel blade 8. In operation preferably, as illustrated in FIGS. 14A, 14C and 14D, the adjustable wear guide 63 is in a first position with the fastener 44 in each adjustable wear guide through hole 97/through hole 92 combination in a first, or lower position, see FIG. 14D. Movement of the fastener 44 to the first or lower position results in the adjustable wear guide being positioned in the direction of the blade upper surface 14. The result of the repositioning is the blade leading edge 96 is lowered towards the surface 6, and substantially planar to base edge 76*a*, see FIG. 14D. Alternatively, the leading edge 96 may be positioned in a second position vertically or substantially vertically above the base edge 76*a*, see FIG. 14B. This positioning allows for the ease of operation as previously described. As illustrated in FIG. 14B, the adjustable wear guide is in the second position with the fastener 44 in each adjustable wear guide through hole 97/through hole 92 combination in a second, or raised, position in the adjustable wear guide through hole 97. This results in lowering the adjustable wear guide away from the blade upper surface 14 and in the direction of the surface 6. The result is the blade leading edge 96 is raised above the surface 6 as compared to the first position previously described. The second position as described allows for larger inconsistencies in the surface 6 while still maintaining the benefits of the invention as previously described.

Figure 15A:
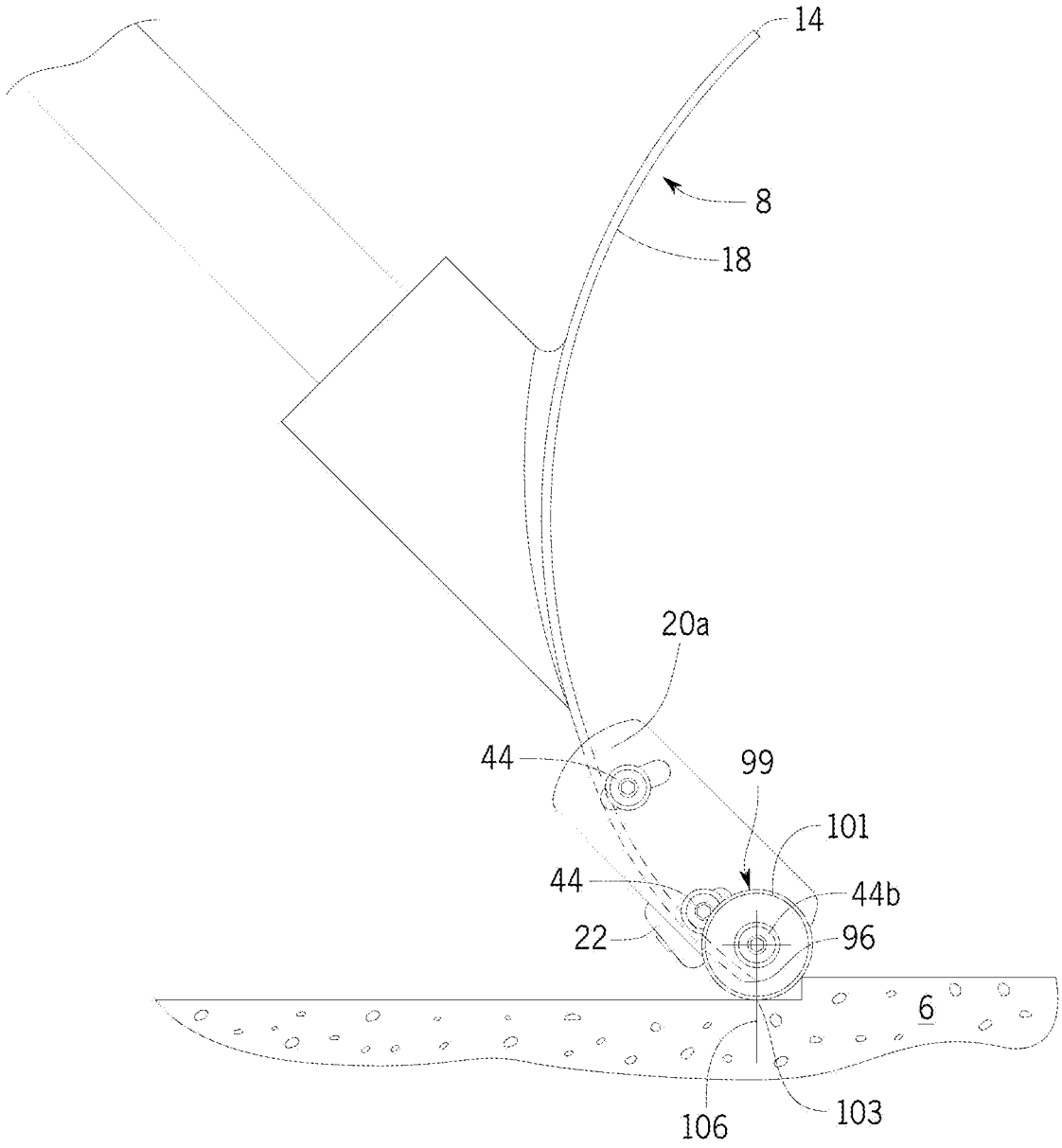
FIG. 15A is a left side view of the invention for the adjustable hand shovel guide illustrating a guide wheel attachment in a first aspect of adjustment.
Figure 15B:
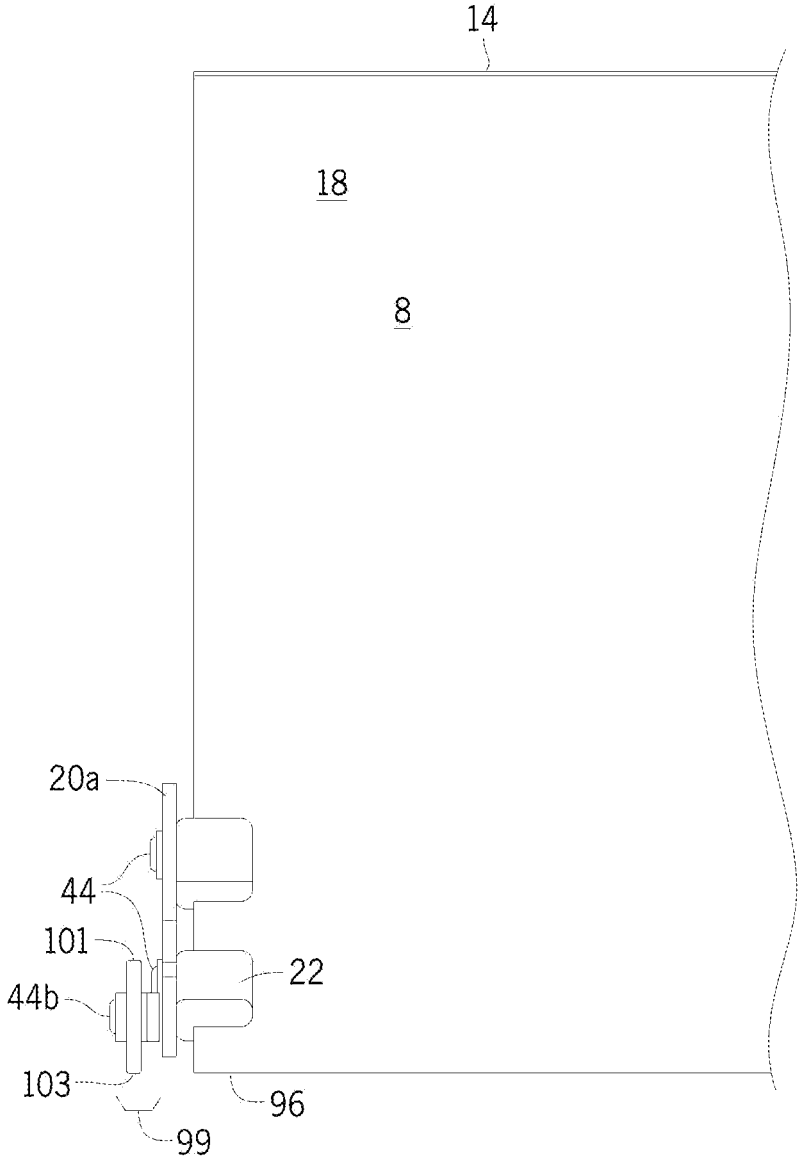
FIG. 15B is a front view of the invention for the adjustable hand shovel guide of FIG. 15A illustrating a guide wheel attachment.
Figure 15C:
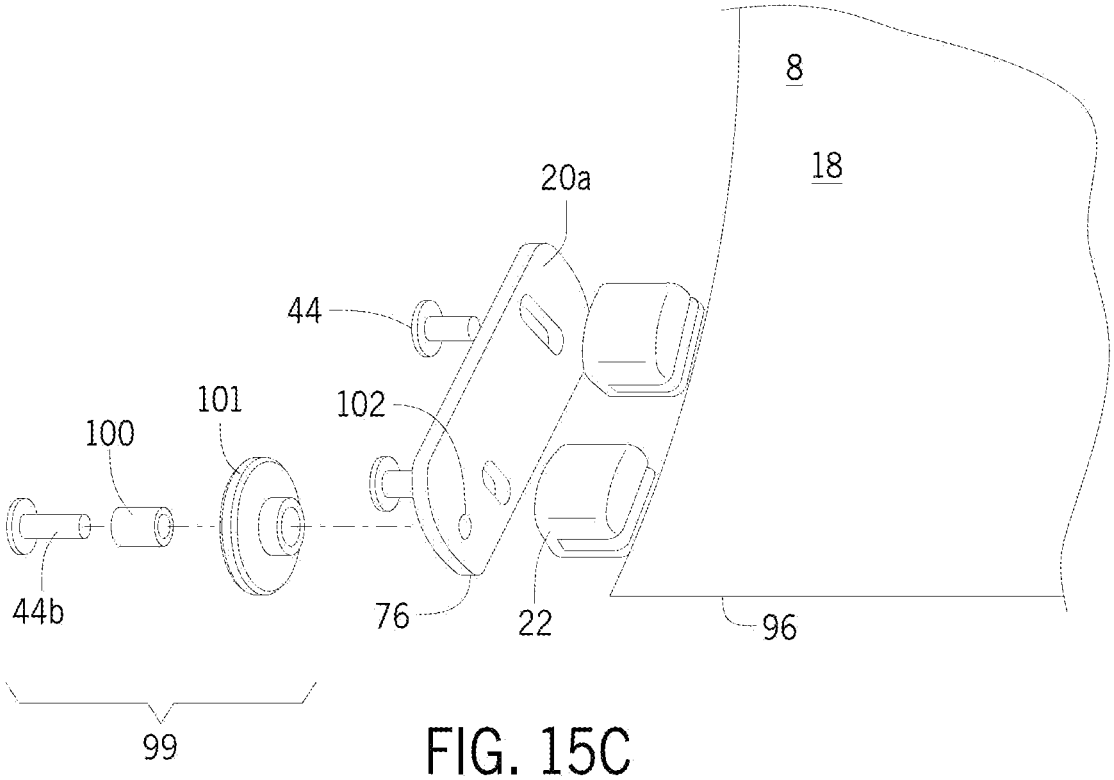
FIG. 15C is a frontal-left exploded view of the invention for the adjustable hand shovel guide of FIG. 15A illustrating a guide wheel attachment.

With attention to FIGS. 15A to 15D, the invention may further comprise a guide wheel attachment 99 positioned towards the first end edge 70, see FIG. 4. As illustrated in the figures the guide wheel attachment 99 may be removably, and rotatably, mounted to a second aspect of the guide plate 20*a* proximate to the base edge 76, see FIG. 5. Note, the guide wheel attachment 99 may be removably, and rotatably, mounted to the guide plate 20 proximate to the base edge 76, for ease of description guide plate 20*a* shall be referenced. As illustrated in FIG. 15C, it is observed the based edge 76 in may be a rounded edge. As illustrated in FIG. 15C, the guide plate 20*a* comprises a guide wheel through hole 102 proximate to the base edge 76. A bushing 100 may be inserted in a central through hole of a guide wheel 101 of the guide wheel attachment 99 to allow for ease of rotation of the guide wheel 101. Further, a wheel fastener 44*b* may be applied through the bushing 100 and the guide wheel through hole 102. The fastener 44*b* is then affixed in or beyond the wheel mounting through hole 102, securing the guide wheel attachment 99 to the guide plate 20*a*. The guide wheel attachment 99 and guide wheel 101 allow for additional ease of movement of the shovel and shovel blade 8 over the surface 6 especially where the shovel and shovel blade 8 are carrying or pushing heavier materials, for example but not limited to snow, ice, natural materials, high density plastics, metals, certain wood fibers, and ceramics. The guide wheel attachment 99 additionally reduces wear on the guide plate 20*a* and the shovel blade 8, for example when either of the guide plate 20*a* and/or shovel blade 8 are raised above the surface 6. Even where guide plate 20*a* or the shovel/shovel blade 8 is in contact with the surface, wear on the respective parts is limited by the guide wheel due to the increased ease of mobility of the shovel/shovel blade 8 due to the guide wheel attachment 99 reducing resistance when the operator pushes the hand shovel in the forward motion of the blade 8 when in operation of the shovel. The wheels further provide ease of use of shovels made of heavier materials, for example where heavier materials are metals and metal alloys, for example steel. Alternatively, the guide wheels may be mounted, permanently or removably, on the respective shovel, and adjustable with respect to the shovel.

Figure 15D:
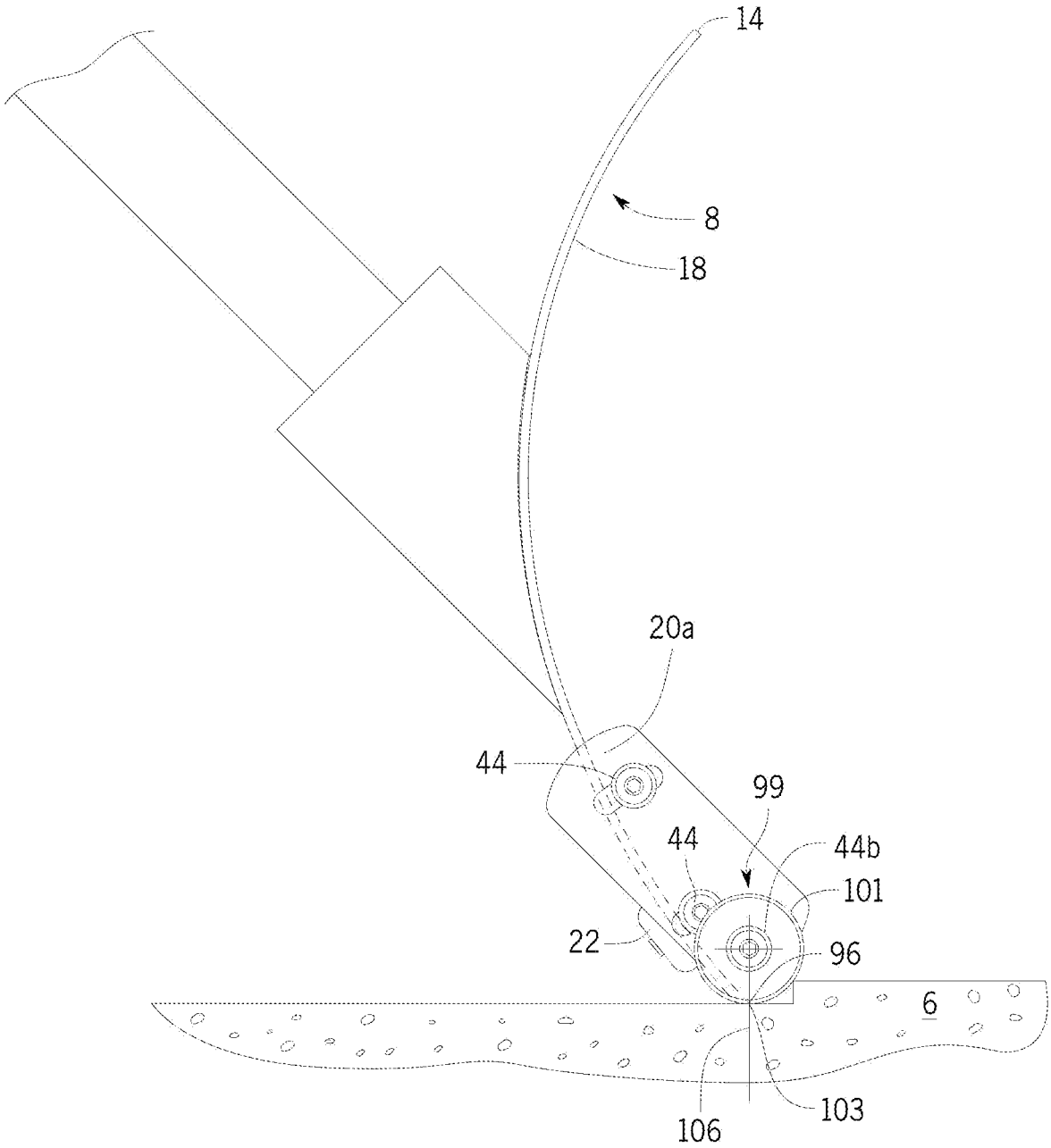
FIG. 15D is a left side view of the invention for the adjustable hand shovel guide of FIG. 15A illustrating the guide wheel attachment orientation to a through hole in a second aspect of adjustment.

With attention to FIGS. 15C and 15D, the wheel mount through hole 102 is positioned through the guide plate 20*a* to provide for a forward position of the guide wheel 101 with respect to the leading edge 96 of the shovel blade 8, see FIG. 12A. The through hole 102 is preferably positioned through the guide plate 20*a* at a location such that when the guide wheel attachment 99 is attached as described to the guide plate 20*a*. Specifically, the guide wheel comprises a lower wheel portion 103 that is located farthest from the upper surface 14 of the blade 8 at any given time. Alternatively stated, the lower wheel portion 103 is the portion of the guide wheel 101 positioned substantially vertical with respect to and below the through hole 102, such the lower wheel portion 103 and through hole 102 are positioned along a reference plane 106 in line with a center of the guide wheel 101, the center of the guide wheel is defined by the crosshairs of FIGS. 15A, 15D, and 16B superimposed over the guide wheel attachment 99 in the figures for reference. The reference plane 106 may be orthogonal or substantially orthogonal to the base edge 76, a portion of the base edge 76, and/or surface 6. As illustrated in FIGS. 15A and 15D, preferably the leading edge 96 is positioned at least substantially proximate to the reference plane 106. Thus, the leading edge 96, lower wheel portion 103, and through hole 102 are in substantial linear alignment. Alternatively, the lower wheel portion 103 of the guide wheel is positioned in front of the leading edge 96 with front defined by the forward motion of the blade 8 when in operation of the shovel. Thus, the leading edge 96 is positioned aft of the reference plane 106 defined by the lower wheel portion 103 and the through hole 102, with aft defined as following reference plane 106 when the blade 8 is in forward motion in operation of the shovel. The described positions of the leading edge 96, lower wheel portion 103, and the through hole 102 with respect to one another allow for ease of raising the leading edge by the guide wheel 101 over the surface 6 and movement of the guide wheel on the surface 6. Raising of the leading edge 96 provides for a disconnection between the surface 6 and the leading edge 96, which results in a reduction of a risk of injury to the operator and allows for the operator to more easily move the shovel blade 8 over the surface 6 while cleaning and/or clearing the surface 6 as compared to use of the shovel/shovel blade 8 without the guide wheel attachment 99. Raising the leading edge in the manner described provides an unanticipated benefit allowing the shovel to remove a majority but not all material on the surface 6 which may allow for traction in movement of persons and vehicles when loose material 82, see FIG. 7, remains on the surface, for example: loose gravel, snow, and/or debris.

Figure 16A:
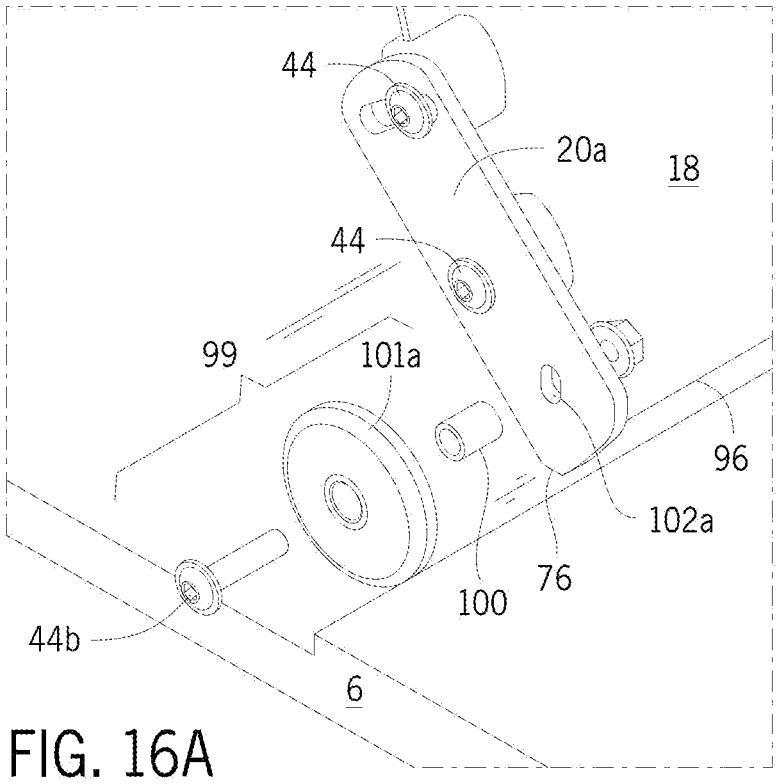
FIG. 16A is a frontal-left partially exploded view of the invention for the adjustable hand shovel guide illustrating the guide wheel attachment, having a second aspect of the guide wheel, in connection with a second aspect of the through hole of the guide plate.
Figure 16B:
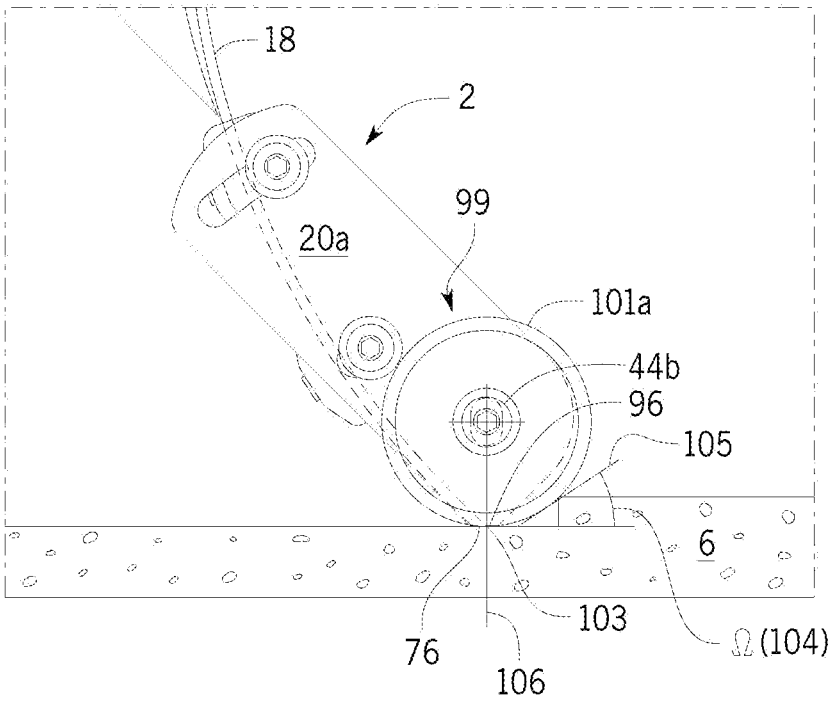
FIG. 16B is a left side view of the invention for the adjustable hand shovel guide of FIG. 16A illustrating the second aspect of the guide wheel.

With attention to FIGS. 16A and 16B, the through hole 102, see FIC. 15C, may be elongated in an orthogonal or substantially orthogonal direction with respect to the surface 6 to provide for an elongated through hole 102*a* and/or a second aspect of the guide wheel 101*a*. The elongation of the through hole 102*a* is orthogonal, or substantially orthogonal, with respect to the base edge 76 of the guide plate 20*a*. The wheel fastener 44*b* is vertically adjustable within the elongated through hole 102*a*. The vertical adjustment of the wheel fastener 44*b* provides for adjustable positioning of the lower wheel portion 103 with respect to the leading edge 96. Thus, the elongated through hole 102*a* allows for at least a substantially vertical adjustment of the guide wheel attachment 99, and the second aspect of the guide wheel 101*a*, to provide for changes in an elevation of the surface 6 due to break lines in the surface. Further, the elongated through hole 102*a* allows for a substantially vertical adjustment of the guide wheel attachment 99 and guide wheel 101*a* without needing to move the guide plate with respect to the blade. It is noted the second aspect of the guide wheel 101*a* may have a larger diameter than the diameter of the guide wheel 101. The larger diameter of the guide wheel 101*a* may provide for improved movement of the blade 8 and leading edge 96 over the surface 6. The improved motion is a result of reduced resistance when the operator pushes the hand shovel in the forward motion of the blade 8 when in operation of the shovel. The improved motion is also a result of the fact that guide wheel 101*a* provides an angle Ω (104) that is smaller than a comparative when a smaller diameter wheel is applied. Ω (104) is the angle between a tangent line 105 to the outer diameter of the guide wheel 101*a* and through or tangent to the edge of the vertically offset surface 6, defining the break line. This smaller angle allows for a more horizontal movement of the wheel which is less restrictive than the movement of a wheel with a smaller diameter. As noted, see FIG. 16B, preferably the leading edge 96 is positioned at least substantially proximate to the reference plane 106. Thus, the leading edge 96, lower wheel portion 103, and through hole 102 are in substantial linear alignment. Alternatively, the lower wheel portion 103 is positioned in front of the leading edge 96 with front defined by the forward motion of the blade 8 when in operation of the shovel. In either orientation, the base edge 76 and leading edge 96 are at least in substantial alignment. In the use of either wheel (101, 101*a*), even where the leading edge 96 is positioned forward of the reference plane 106, the shovel/shovel blade 8 achieves unexpected results when the base edge 76 and leading edge 96 are at least in substantial alignment, see FIGS. 15A-16B.

It is observed that the guide wheel (101, 101*a*) of the guide wheel attachment 99 of FIGS. 15A-15D and 16A and 16B has the vertical orientation with respect to the base edge 76, as discussed. The through hole (102, 102*a*) may be positioned forward of the leading edge 96 of the shovel as previously noted which results in the lower wheel portion 103 being positioned forward of the leading edge 96. The through hole (102, 102*a*) may be positioned behind of the leading edge 96 of the shovel as previously noted which results in the lower wheel portion 103 being positioned behind the leading edge 96. The through hole (102, 102*a*) may be positioned vertically above and at least substantially in-line with the leading edge 96 of the shovel as previously noted which results in the lower wheel portion 103 being planar with respect to the leading edge 96. In this context, 'behind' is a direction opposite of forward and opposite the forward motion of the shovel. In this context, 'above' references the direction towards the upper surface 14 of the shovel blade 8 with respect to the leading edge 96, see FIGS. 1 and 15D. The ability to position the guide wheel 101*a* with respect to the wheel guide plate 20*a* and the shovel blade 8 in multiple orientations is facilitated by the positioning of base edge 76 with respect to the leading edge of the blade. Specifically, the base edge 76 is preferably vertically aligned with the leading edge 96 and the surface 6, and more preferably the leading edge 96 is preferably in planar alignment with the base edge first corner 88, see FIG. 12A. Alternatively, the base edge 76 is forward of the leading edge 96. Such orientations of the base edge 76 with respect to the leading edge 96 allows for the wheel to move along the surface 6 without the leading edge 96 impeding motion of the shovel as previously described. It is observed the base edge 76 may be positioned to be at least substantially in contact with the surface 6, see FIG. 16B. The contact of the base edge 76 with the surface 6 in combination with the lower portion 103 of the guide wheel 101*a* may provide for navigation of the shovel blade 8 and leading edge 96 over the surface 6. Additionally, assembly and adjustment of the adjustable shovel guide 2, and/or alignment of the leading edge 96 with the lower wheel portion 103, is optimized and facilitated when the base edge 76 is in contact with the surface 6.

The present invention addresses the need for an apparatus for addressing break lines on surfaces, and loose material surfaces, while operating hand shovels. Though the prior art provides for guides for shovel blades. The prior art shovel guides are positioned at the lower surface of the blade and thus unable to be adjusted along the blade from the lower surface of the blade to the upper surface of the blade. Alternatively, where the prior art shovel guide is positioned along a side edge of the shovel blade, the prior art guide is mounted to the shovel blade resulting in impairment of the shovel blade and an inability to adjust the shovel blade without additional procedures. By contrast, the present invention for an adjustable shovel guide 2 provides for removable attachment and adjustment of the adjustable shovel guide 2 to the shovel blade 8. This allows for removable adjustment of the shovel guide 2 without physically impairing the blade of the hand shovel. The prior art shovel blades, which are affixed to the edges of the blade or the blade lower surface, do not adjust along the edge of the blade between the lower surface of the blade and the upper surface of the blade without extensive secondary procedures not directly related to the prior art guide. The prior art guides are mounted through the blade in a permanent manner increasing the time of operation of the shovel over that of the present invention and impairing the shovel as previously stated. Thus, individual prior art guides do not intrinsically provide for a first aspect of adjustment and a second aspect of adjustment. By contrast, the adjustable shovel guide 2 is adjustable in a first aspect of adjustment along the edge of the blade as previously described reducing wear on at least one of the lower surface 12 and the leading edge 96. In conjunction with this first aspect, the adjustable shovel guide 2 is adjustable along a second aspect of adjustment which involves positioning the guide plate (20, 20*a*) about the mounting fasteners (44, 44*a*). The combination of the first adjustment aspect and the second adjustment aspect provides for repositioning of the base edge first corner 88 ahead of, planar with, or behind the leading edge 96 of the blade. The combination of the first adjustment aspect and the second adjustment aspect additionally provides for radial or vertical raising and lowering of the lower surface 12 with respect to the surface 6 on which the lower surface 12 is operated. The multi-aspect and multi-directional adjustment of the guide plate (20, 20*a*), and potentially the adjustable wear guide 63 and/or guide wheel attachment 99, provides for mechanical alteration of the adjustable shovel guide 2 with respect to the shovel 4, shovel blade 8, and the surface 6 which is not provided for in the prior art. This multi-aspect and multi-directional adjustment allows the operator to continue a forward motion of the shovel and shovel blade without the need to vertically lift the shovel and shovel blade. Therefore, the adjustable shovel guide 2 may reduce the risk of injury to the operator of the hand shovel when a material is positioned on or in the shovel blade. With that, the adjustable hand shovel guide additionally allows for ease of moving the hand shovel over gaps in the surface where the gap has a significant width.

While this invention has been described in conjunction with the exemplary embodiments outlined above, various alternatives, modifications, variations, improvements and/or substantial equivalents, whether known or that are or may be presently foreseen, may become apparent to those having at least ordinary skill in the art. Accordingly, the exemplary embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents. Features of any one embodiment/aspect may be incorporated in another embodiment/aspect of the invention.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The phrase "at least one of . . . and . . . ." as used herein refers to and encompasses any and all possible combinations of one or more of the associated listed items. As an example, the phrase "at least one of A, B, C" includes A only, B only, C only, or any combination thereof (e.g., AB, AC, BC, or ABC).

It should be noted that, in some alternative implementations, the functions noted in the block may occur out of the order noted in the figures. For example, two blocks shown in succession may in fact, be executed substantially concurrently, or the blocks may sometimes be executed in the reverse order, depending on the functionality involved.

For the purpose of this disclosure, the term "coupled" means the joining of two members directly or indirectly to one another. Such joining may be stationary in nature or moveable in nature. Such joining may be achieved with the two members, or the two members and any additional intermediate members being integrally formed as a single unitary body or with the two members or the two members and any additional intermediate members being attached to one another. Such joining may be permanent in nature or may be removable or releasable in nature.

The terms fixedly, non-fixedly, and removably, and variations thereof, may be used herein. The term fix, and variations thereof, refer to making firm, stable, or stationary. It should be understood, though, that fixed does not necessarily mean permanent-rather, only that a significant or abnormal amount of works needs to be used to make unfixed. The term removably, and variations thereof, refer to readily changing the location, position, and/or station. Removably is meant to be the anonym of the term fixedly. Alternatively, the term non-fixedly can be used as the antonym of fixedly.

Preferences and options for a given aspect, feature or parameter of the disclosure should, unless the context indicates otherwise, be regarded as having been disclosed in combination with any and all preferences and options for all other aspects, features, and parameters of the disclosure.

Aspects herein can be embodied in other forms without departing from the spirit or essential attributes thereof. Accordingly, reference should be made to the following claims, rather than to the foregoing specification, as indicating the scope hereof.

What is claimed is:

1. An apparatus for an adjustment of a shovel blade for a hand shovel, apparatus comprising:

a guide plate attached to at least one plate mount with the at least one plate mount removably attached to a shovel blade edge, with the shovel blade having a leading edge substantially orthogonal to the shovel blade edge;

the guide plate having a first adjustment, a relocation of the at least one plate mount along a length of the shovel blade edge provides for the first adjustment of the guide plate along the shovel blade edge;

the guide plate having a second adjustment, the second adjustment having an angle of the guide plate with respect to the shovel blade; and one or more of the first adjustment and the second adjustment having a change of a position of the guide plate with respect to the shovel blade.

2. The apparatus of claim 1, wherein the guide plate has one or more through passages, with the one or more through passages being elongated, where the second adjustment being a movement of the guide plate along the one or more through passages.

3. The apparatus of claim 2, wherein the one or more through passages are extending substantially orthogonal or acute to the shovel blade edge.

4. The apparatus of claim 1, wherein the guide plate comprises a base edge.

5. The apparatus of claim 1, further comprising an adjustable wear guide adjustably attached to the guide plate, proximate to the leading edge, and having a third adjustment.

6. The apparatus of claim 5, wherein the third adjustment provides for a change of a position of the adjustable wear guide with respect to the guide plate.

7. The apparatus of claim 1, wherein a guide wheel is attached to the guide plate.

8. The apparatus of claim 7, wherein the guide plate, the guide wheel, and the shovel blade edge are in a laminar layered relationship from the shovel blade edge.

9. The apparatus of claim 7, wherein the guide wheel provides for an increased movement of the shovel blade.

10. An apparatus comprising:

a hand shovel having a shovel blade; and an adjustable wear guide, comprising:

at least one plate mount removably attached to an edge of the shovel blade, with the shovel blade having a leading edge substantially orthogonal to the edge;

a guide plate removably attached to the at least one plate mount;

the at least one plate mount having a first adjustment being a relocation of the at least one plate mount along the shovel blade edge which provides for a position of the guide plate along the shovel blade edge; and the guide plate having a second adjustment, the second adjustment having an angle of the guide plate with respect to the shovel blade; and one or more of the first adjustment and the second adjustment having a change of position of the guide plate with respect to the shovel blade.

11. The apparatus of claim 10, wherein the guide plate has one or more through passages, with the one or more through passages being elongated, where the second adjustment being a movement of the guide plate along the one or more through passages.

12. The apparatus of claim 11, wherein the one or more through passages are extending substantially orthogonal or acute to the edge.

13. The apparatus of claim 10, wherein the guide plate comprises a base edge.

14. The apparatus of claim 10, further comprising an adjustable wear guide attached to the guide plate, proximate to the leading edge, and having a third adjustment.

15. The apparatus of claim 14, wherein the third adjustment provides for a change of a position of the adjustable wear guide with respect to the guide plate.

16. The apparatus of claim 10, wherein a guide wheel is attached to the guide plate.

17. The apparatus of claim 16, wherein the guide plate, the guide wheel, and the edge are in a layered relationship from the edge.

18. A method for adjusting a position of a shovel blade for a hand shovel with respect to a surface, method comprising:

removably attaching a guide plate to an edge of the shovel blade, with the shovel blade having a leading edge substantially orthogonal to the edge, the guide plate comprising:

at least one plate mount removably attached to an edge of the shovel blade; and the guide plate removably attached to the at least one plate mount;

making a first adjustment of the at least one plate mount, allowing for a repositioning of the guide plate along a length of the edge;

causing a second adjustment allowing for a manipulation of the position of the guide plate with respect to the length; and one or more of the first adjustment and the second adjustment having a change of a position of the guide plate with respect to the shovel blade.

* * * * *